US009834007B2

(12) United States Patent
Sone et al.

(10) Patent No.: US 9,834,007 B2
(45) Date of Patent: Dec. 5, 2017

(54) MEDICAL PRINTER

(71) Applicant: SONY CORPORATION, Tokyo (JP)

(72) Inventors: Masakazu Sone, Kanagawa (JP); Hideo Nakamura, Kanagawa (JP)

(73) Assignee: SONY CORPORATION, Tokyo (JP)

( * ) Notice: Subject to any disclaimer, the term of this patent is extended or adjusted under 35 U.S.C. 154(b) by 0 days.

(21) Appl. No.: 15/325,869

(22) PCT Filed: May 20, 2015

(86) PCT No.: PCT/JP2015/064488
§ 371 (c)(1),
(2) Date: Jan. 12, 2017

(87) PCT Pub. No.: WO2016/017249
PCT Pub. Date: Feb. 4, 2016

(65) Prior Publication Data

US 2017/0165985 A1 Jun. 15, 2017

(30) Foreign Application Priority Data

Jul. 30, 2014 (JP) ..... 2014-154713

(51) Int. Cl.
*B41J 2/32* (2006.01)
*B41J 11/00* (2006.01)
(Continued)

(52) U.S. Cl.
CPC ..... *B41J 2/32* (2013.01); *B41J 2/04523* (2013.01); *B41J 11/00* (2013.01); *B41J 11/66* (2013.01);
(Continued)

(58) Field of Classification Search
CPC ..... B41J 2/32; B41J 11/00; B41J 11/66; B41J 11/706; B41J 11/70; B41J 2/04523; B41J 11/703
See application file for complete search history.

(56) References Cited

U.S. PATENT DOCUMENTS 4,907,014 A * 3/1990 Tzeng ..... B26D 1/205 346/136
5,833,380 A * 11/1998 Hosomi ..... B26D 1/305 346/24
(Continued)

FOREIGN PATENT DOCUMENTS

JP 05-049350 U 6/1993
JP 05-147285 A 6/1993
(Continued)

*Primary Examiner* — Julian Huffman
(74) *Attorney, Agent, or Firm* — Oblon, McClelland, Maier & Neustadt, L.L.P.

(57) ABSTRACT

To provide a medical printer (100) that can cut a roll sheet (P) by pulling the roll sheet (P) in any of an up direction and a down direction. There is provided a medical printer including: a main body (102) that accommodates a roll sheet; a movable section (104) including a front panel (104A) that covers a front face, the movable section being capable of opening and closing against the main body; a first cutting section (130) provided on the movable section, and configured to cut the roll sheet ejected from an ejection port (110) defined by the main body and the movable section; and a slide section configured to slide the front panel or the first cutting section in a radial direction with respect to a rotation center of the movable section in accordance with open and closed states of the movable section.

8 Claims, 16 Drawing Sheets

(51) Int. Cl.
*B41J 11/66* (2006.01)
*B41J 11/70* (2006.01)
*B41J 2/045* (2006.01)

(52) U.S. Cl.
CPC ..... *B41J 11/70* (2013.01); *B41J 11/703* (2013.01); *B41J 11/706* (2013.01)

(56) References Cited

U.S. PATENT DOCUMENTS

| | | | | |
|---|---|---|---|---|
| 7,510,343 | B1 | 3/2009 | Arrington et al. | |
| 2007/0022858 | A1* | 2/2007 | Shirotori | B26D 1/085 83/624 |
| 2009/0148217 | A1* | 6/2009 | Sanada | B26D 1/085 400/120.16 |
| 2010/0119283 | A1* | 5/2010 | Hosono | B41J 3/4075 400/621 |
| 2011/0026999 | A1* | 2/2011 | Kohira | B26D 1/085 400/621 |
| 2011/0103869 | A1* | 5/2011 | Shirotori | B41J 3/4075 400/621 |
| 2011/0170930 | A1* | 7/2011 | Kawaguchi | B26D 1/085 400/621 |
| 2011/0170931 | A1* | 7/2011 | Kawaguchi | B26D 1/085 400/621 |

FOREIGN PATENT DOCUMENTS

| | | | | |
|---|---|---|---|---|
| JP | 07-017498 | Y2 | 4/1995 | |
| JP | 07-018847 | U | 4/1995 | |
| JP | 08-034553 | A | 2/1996 | |
| JP | 2000-052291 | A | 2/2000 | |
| JP | 2009-255350 | A | 11/2009 | |
| JP | WO 2009157103 | A1 * | 12/2009 | B62D 7/22 |
| JP | 2011-037064 | A | 2/2011 | |
| JP | 2012-213944 | A | 11/2012 | |
| JP | 2014-176916 | A | 9/2014 | |

* cited by examiner

MEDICAL PRINTER

CROSS REFERENCE TO RELATED APPLICATIONS

This application is a U.S. National Phase of International Patent Application No. PCT/JP2015/064488 filed on May 20, 2015, which claims priority benefit of Japanese Patent Application No. JP 2014-154713 filed in the Japan Patent Office on Jul. 30, 2014. Each of the above-referenced applications is hereby incorporated herein by reference in its entirety.

TECHNICAL FIELD

The present disclosure relates to a medical printer that prints on a roll sheet.

BACKGROUND ART

Printers are requested to have the performance and usability according to where and how the printers are used. It is also necessary for printers for medical use to have different performance and usability in accordance with situations such as medical care, examination, and other medical matters in which the printers are used. Speaking of performance, printers that print, for example, medical records have to have high-performance of printing fast. Printers for echography have to have such image quality that no light and shade are produced from rough surfaces of printing sheets and irregularity particular to the machines because the printers that print images resulting from echography allow states of affected areas and unborn children to be expressed in light and dark colors for diagnosis. Meanwhile, speaking of usability, printers have to be easily operated and space-saving, which namely means that the printers are not particular about where to be disposed upon use.

For example, a printer mounted and used on a cart 10 as illustrated in FIG. 18 together with a medical examination device 15, a keyboard 16, and a display 17 is suitable as a printer that prints on a roll sheet that is a rolled long sheet, the cart 10 being can be moved by wheels 12 under a base 11. Printers that print on a roll sheet can cut the sheet in accordance with a quantity of print. Moreover, such printers can efficiently accommodate a sheet, thereby being easy to downsize.

Printers that print on a roll sheet have to cut a part of the roll sheet on which the printers have already printed as the printers are outputting the roll sheet. If printers are equipped with an automatic cutting mechanism for automatically cutting a roll sheet, the printers become larger and cost more. Accordingly, there are also a large number of printers that adopt a manual cutting mechanism that allows users to cut a roll sheet by pulling the roll sheet in contact with a cutter blade. For example, Patent Literatures 1 and 2 disclose printers equipped with a manual cutting mechanism. The manual cutting mechanisms disclosed in Patent Literatures 1 and 2 each allow users to grasp a roll sheet ejected from the printer, to turn up the roll sheet in the opposite direction to the ejecting direction, and to pull the roll sheet in contact with the cutter blade in order to make a crack on the roll sheet and cut the roll sheet.

CITATION LIST

Patent Literature

Patent Literature 1: JP 2011-37064A
Patent Literature 2: JP H08-34553A

DISCLOSURE OF INVENTION

Technical Problem

However, the printers disclosed in Patent Literatures 1 and 2 have a limited direction in which a roll sheet is pulled when the roll sheet is cut. Moreover, the printers are disposed in a limited place. Since small printers have no clearance for pulling down a roll sheet, a manual cutting mechanism is usually attached to the conveyance passage of a roll sheet such that the roll sheet is pulled up to be cut. However, supposing, for example, that a printer 18 is mounted on the cart 10 as illustrated in FIG. 18, the printer 18 can be disposed only on a shelf 14*b* or 14*c* under a table 14*a* on which the keyboard 16 is mounted in the example of FIG. 18. For example, when the printer 18 is disposed on the shelf 14*b*, no clearance for pulling a roll sheet can be provided above the manual cutting mechanism so that it becomes difficult to cut the roll sheet.

It is also conceivable that a manual cutting mechanism is additionally attached to a lower face of conveyance passage of a printer such that a roll sheet can be pulled down to be cut. However, the roll sheet ejection port is generally a movable section that is opened and closed such that the printer accommodates a roll sheet. There is no providing a cutter blade to the movable section for structural safety reasons.

The present disclosure therefore proposes a novel and improved medical printer that can cut a roll sheet by pulling the roll sheet in any of the up direction and the down direction.

Solution to Problem

According to the present disclosure, there is provided a medical printer including: a main body that accommodates a roll sheet; a movable section including a front panel that covers a front face, the movable section being capable of opening and closing against the main body; a first cutting section provided on the movable section, and configured to cut the roll sheet ejected from an ejection port defined by the main body and the movable section; and a slide section configured to slide the front panel or the first cutting section in a radial direction with respect to a rotation center of the movable section in accordance with open and closed states of the movable section.

Advantageous Effects of Invention

According to the present disclosure as described above, there is provided a medical printer that can cut a roll sheet even if the roll sheet is pulled in any of the up direction and the down direction. Note that the effects described above are not necessarily limitative. With or in the place of the above effects, there may be achieved any one of the effects described in this specification or other effects that may be grasped from this specification.

MODE(S) FOR CARRYING OUT THE INVENTION

Figure 1:
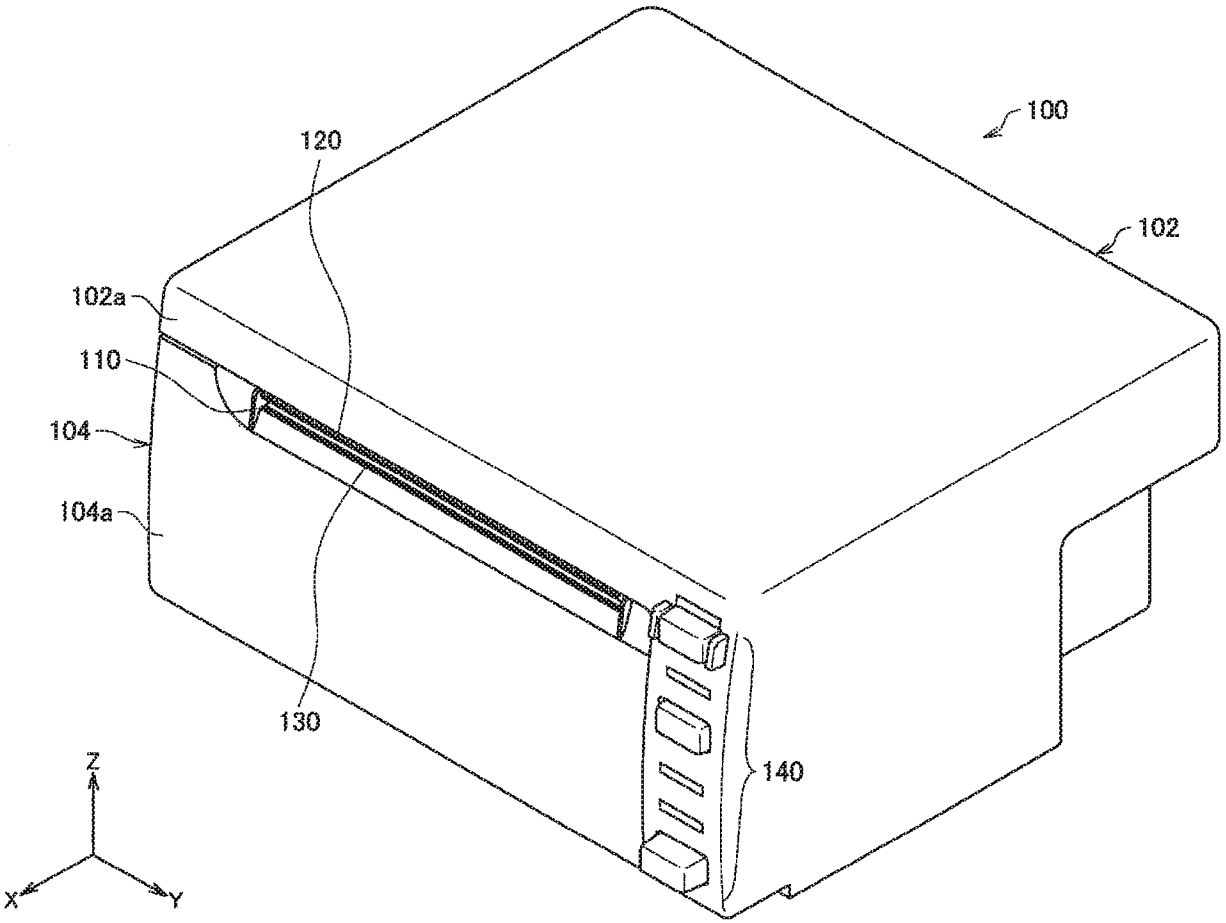
FIG. 1 is an overall perspective view illustrating a medical printer according to a first embodiment of the present disclosure.

Hereinafter, (a) preferred embodiment(s) of the present disclosure will be described in detail with reference to the appended drawings. In this specification and the appended drawings, structural elements that have substantially the same function and structure are denoted with the same reference numerals, and repeated explanation of these structural elements is omitted.

The description will be now made in the following order.

1. First embodiment (front panel slid by cam mechanism)
1.1. Overall configuration
1.2. Manual cutting mechanism
(1) Upper cutting section (second cutting section)
(2) Lower cutting section (first cutting section)
(3) Slide section
1.3. Cutting roll sheet
2. Second embodiment (front panel slid by protrusion)
2.1. Protrusion
2.2. Front panel slid by protrusion
3. Third embodiment (lower cutting section slid by guide section)
3.1. Configuration of lower cutting section
3.2. Sliding cutter blade
4. Fourth embodiment (lower cutting section slid by cam mechanism)
4.1. Configuration of lower cutting section
4.2. Sliding cutter blade <1. First Embodiment>

[1.1.Overall Configuration]

Figure 2:
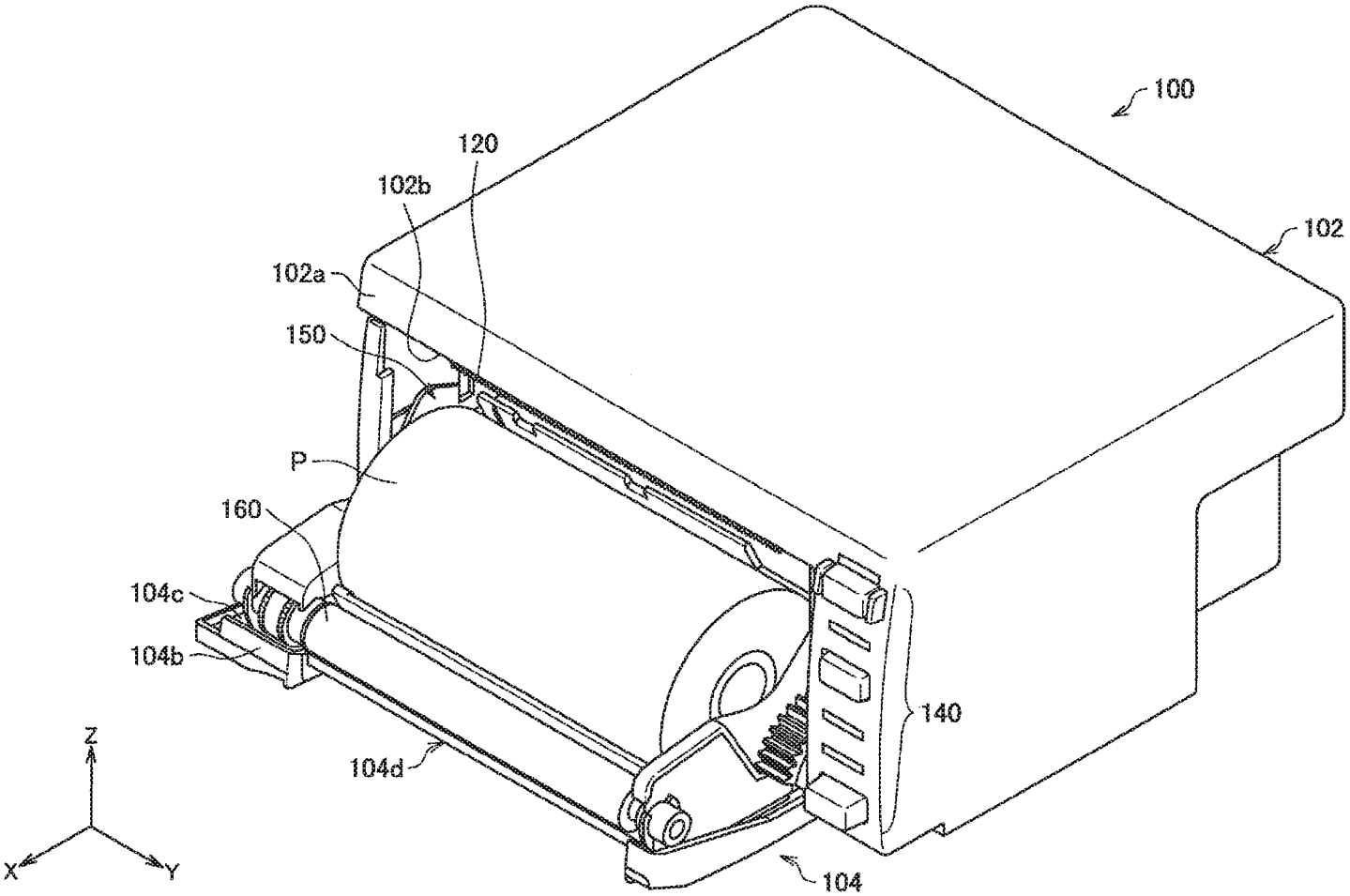
FIG. 2 is an overall perspective view illustrating that a movable section of the medical printer according to the embodiment is opened.

First of all, with reference to FIGS. 1 and 2, the schematic configuration of a medical printer 100 according to a first embodiment of the present disclosure will be described. FIG. 1 is an overall perspective view of the medical printer 100 according to the present embodiment. FIG. 2 is an overall perspective view illustrating that a movable section 104 of the medical printer 100 according to the present embodiment is opened. The medical printer 100 will also be simply referred to as a printer 100 below.

Figure 18:
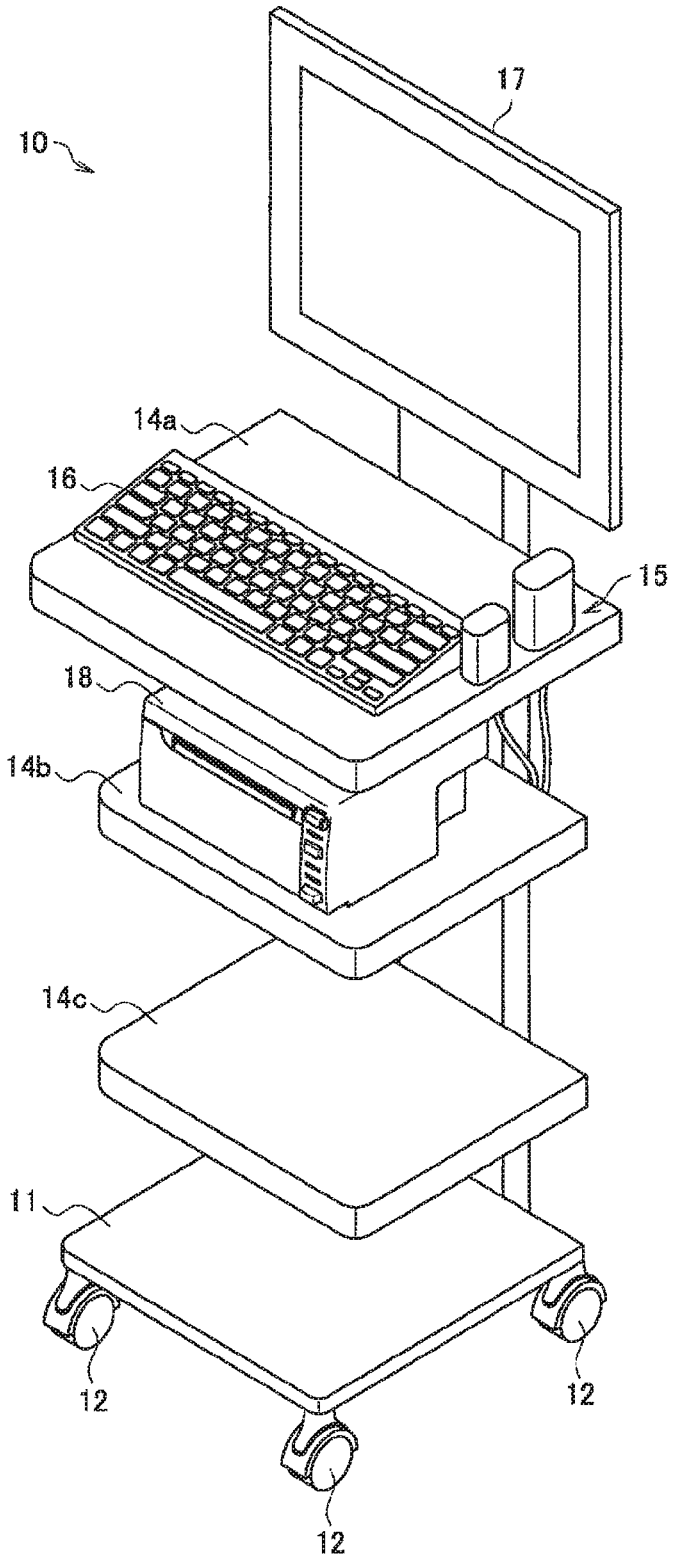
FIG. 18 is a perspective view for describing an installation example of a printer mounted on a cart.

The medical printer 100 according to the present embodiment is, for example, a thermal printer that prints images on a roll sheet, the images being generated on the basis of reception signals from a probe that is provided to an ultrasonic diagnostic device and is a medical examination device configured to generate and transmit ultrasound and receive ultrasound reflected in a living body. The present technology can be applied to not only the medical printer 100, but also any printer including a manual cutting mechanism that allows users to cut a roll sheet. The medical printer 100 is considered to be mounted and used on the cart 10 as illustrated in FIG. 18 like the printer 18.

The medical printer 100 according to the present embodiment is considered to be a thermal printer, but the present disclosure is not limited to such an example. For example, the medical printer 100 may also be an inkjet printer. In this way, the present technology is applicable regardless of printer's printing type. Accordingly, the description about a printing function of the printer being omitted, a main body 102 of the printer 100 includes a print unit that prints on a roll sheet P. The material or the thickness of the roll sheet P is not particularly limited. For example, a thermal film having a thickness of approximately 100 μm may be used for the roll sheet P.

The medical printer 100 according to the present embodiment is, for example, a thermal printer that prints on the roll sheet P. As illustrated in FIG. 1, the housing of the medical printer 100 includes the main body 102 and the movable section 104 provided in a manner that the movable section 104 can be opened and closed with respect to the main body 102.

The main body 102 is a case that accommodates a print unit (not illustrated) that prints on the roll sheet P. An accommodation section 150 that accommodates the roll sheet P is disposed on the face (which will be referred to as "main body front face") 102*a* in the x-axis positive direction of the main body 102, as illustrated in FIG. 2. The movable section 104 provided on the main body front face 102*a* is opened so that the roll sheet P can be accommodated in the accommodation section 150. The main body front face 102*a* is also provided with an operation display section 140 including a power switch, an open button for opening the movable section 104, and a lamp indicating the activity state of the printer 100. The movable section 104 and the operation display section 140 are disposed together on the main body front face 102*a*, which allows the printer 100 to be operated if nothing is placed in front of the main body front face 102*a* of the printer 100.

The movable section 104 is a cover member provided on the main body front face 102*a* in a manner that the movable section 104 can be opened and closed with respect to the main body 102, the movable section 104 being disposed to cover the accommodation section 150 for the roll sheet P in the main body 102. The movable section 104 includes, for example, a bearing (not illustrated) that pivotably supports a shaft (not illustrated) provided on the bottom face side of the printer 100 and extending in the width direction (y direction). The bearing of the movable section 104 pivotably supports the shaft of the main body 102, and a hinge is consequently formed. As illustrated in FIG. 2, the upper part side of the main body front face 102*a* of the movable section 104 can be configured to move with respect to the main body 102.

A part of an upper end 104*b* of the movable section 104 is recessed in the height direction (z direction), thereby forming a recess 104*d*. The recess 104*d* makes a slight gap between the upper end 104*b* of the movable section 104 and a lower end 102*b* of the main body front face 102*a*, the lower end 102*b* facing the upper end 104*b*. The gap functions as an ejection port 110, from which the roll sheet P is conveyed along the conveyance passage inside the printer 100 and ejected. The ejection port 110 includes a manual cutting mechanism for cutting the ejected roll sheet P.

After the print unit prints on the roll sheet P accommodated in the accommodation section 150, the roll sheet P is conveyed along the conveyance passage inside the printer 100 and ejected from the ejection port 110. A conveyor roller 160 that conveys the roll sheet P to the ejection port 110 is provided in front of the ejection port 110 as illustrated in FIG. 2.

[1.2. Manual Cutting Mechanism]

Figure 3:
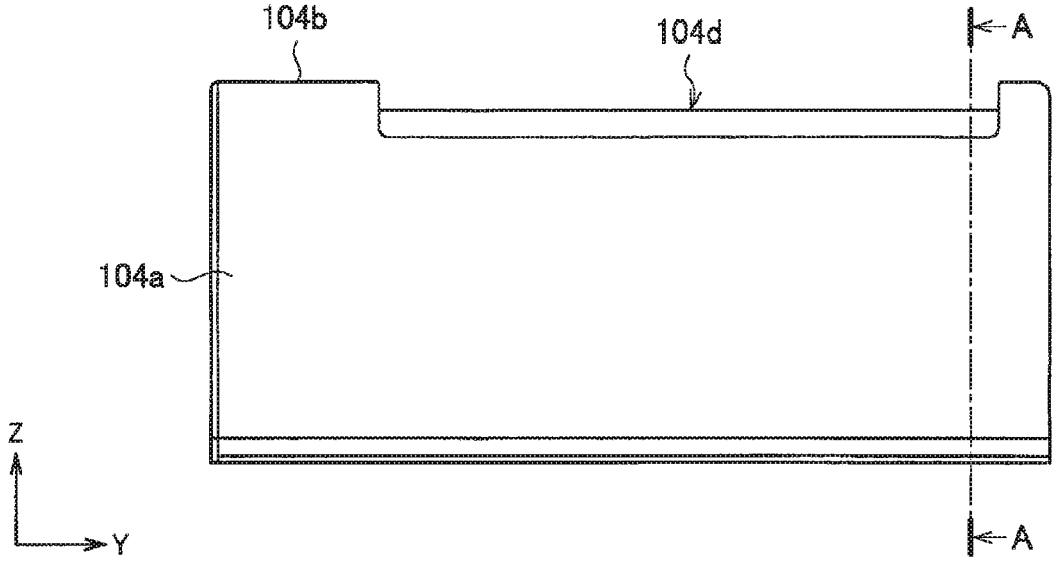
FIG. 3 is a front view of the movable section.
Figure 4:
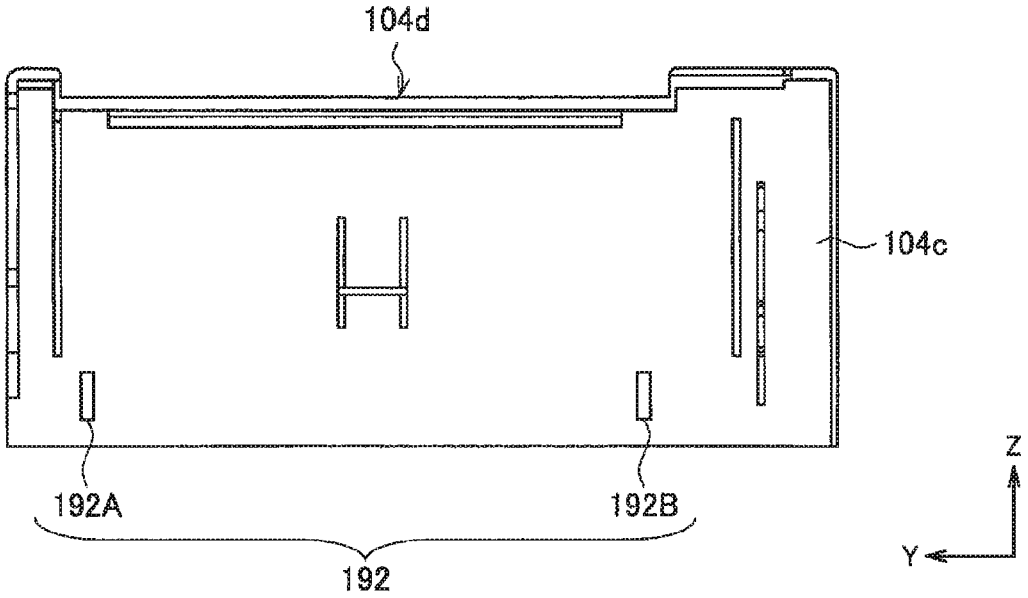
FIG. 4 is a back view of the movable section.
Figure 5:
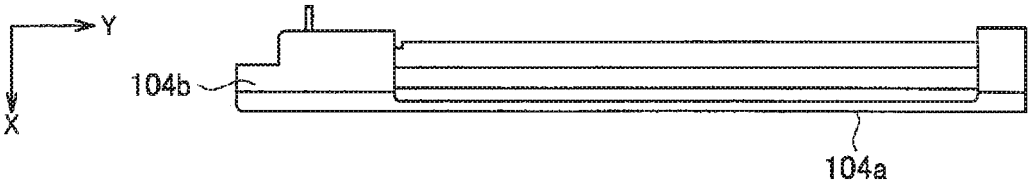
FIG. 5 is a top view of the movable section.
Figure 6:
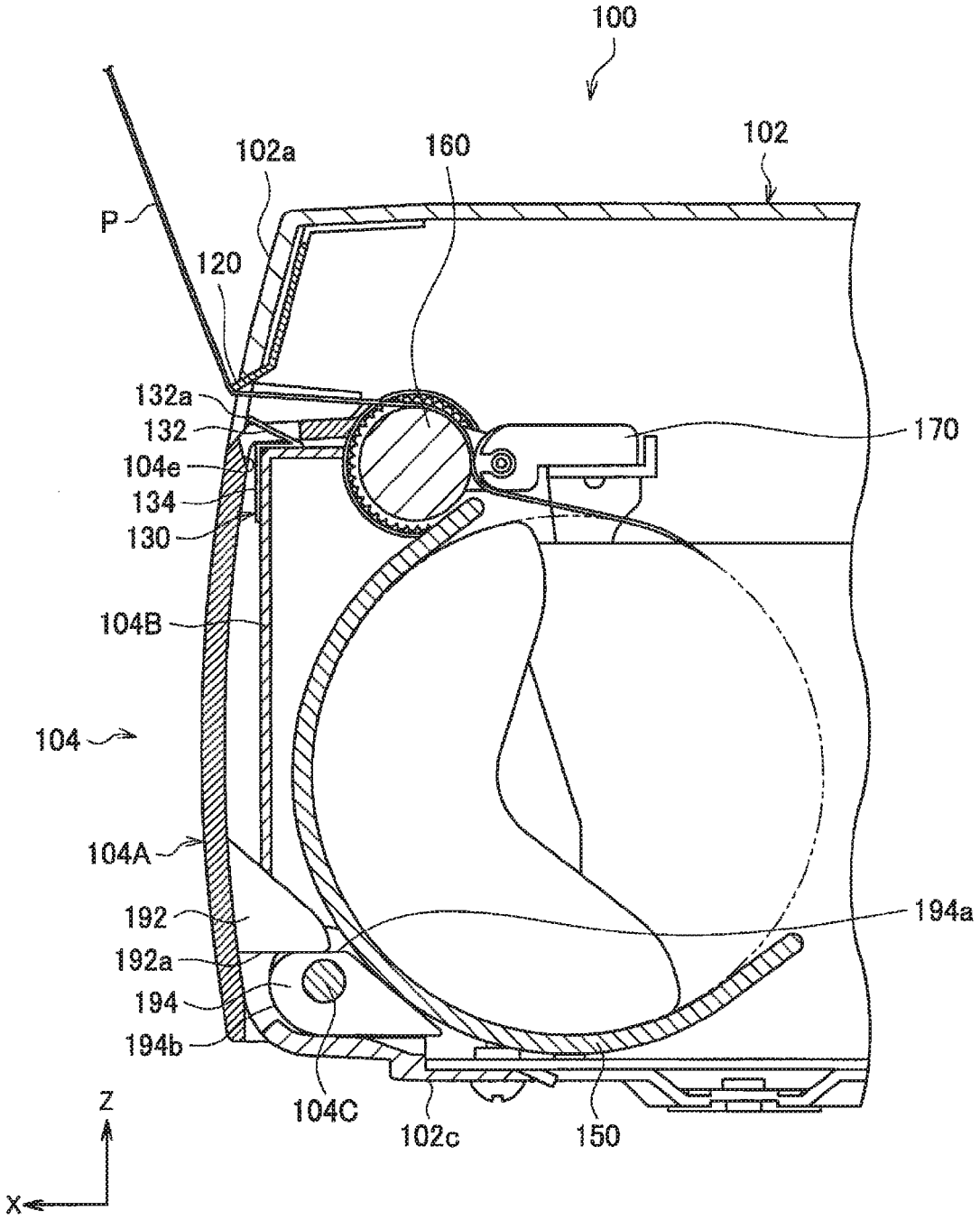
FIG. 6 is a partial cross-sectional view corresponding to an A-A cross section of FIG. 3 and illustrating a closed state in which the movable section is closed against a main body, and illustrates that an upper cutting section is cutting a roll sheet P.
Figure 7:
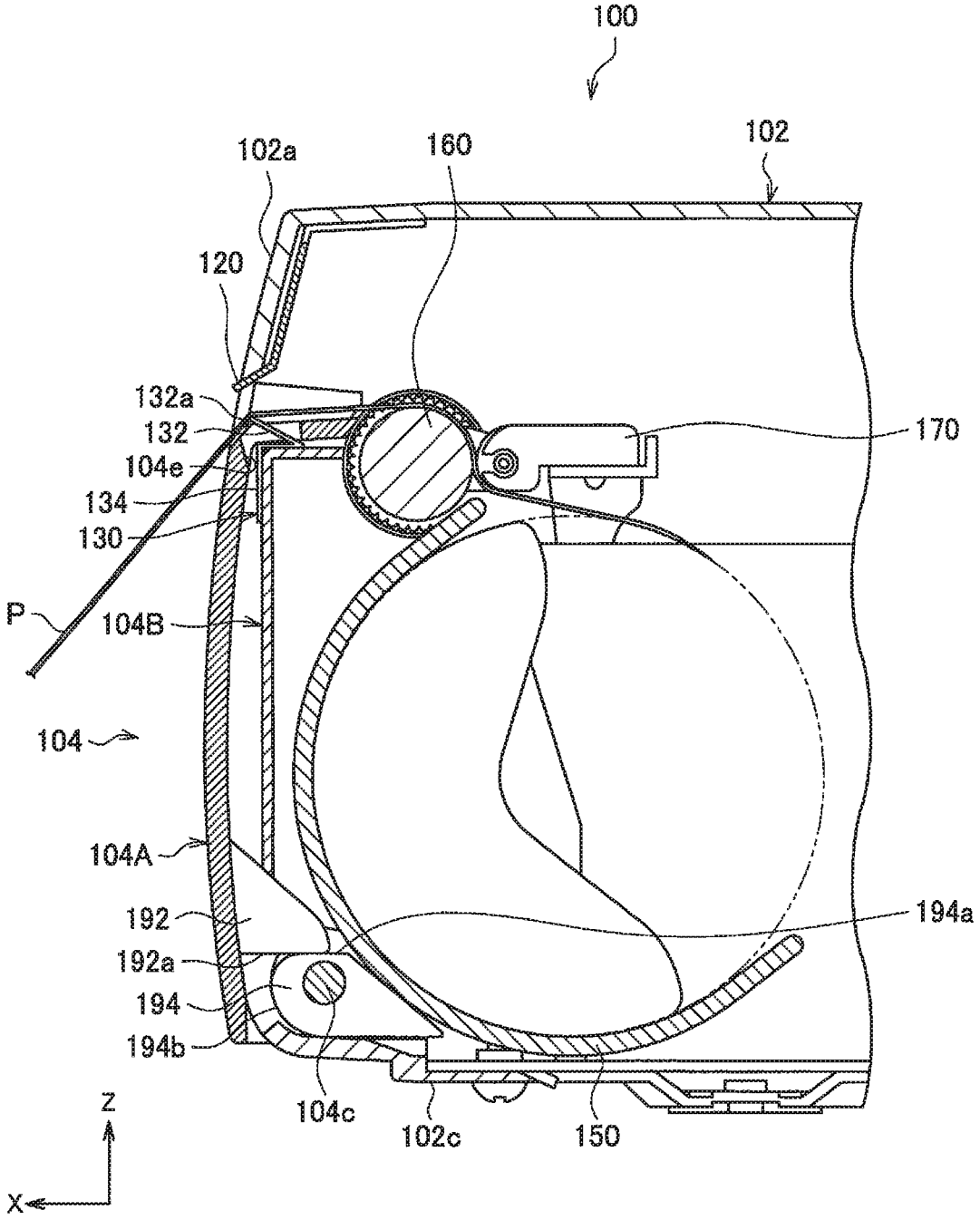
FIG. 7 is a same partial cross-sectional view as FIG. 6, and illustrates that a lower cutting section is cutting the roll sheet.
Figure 8:
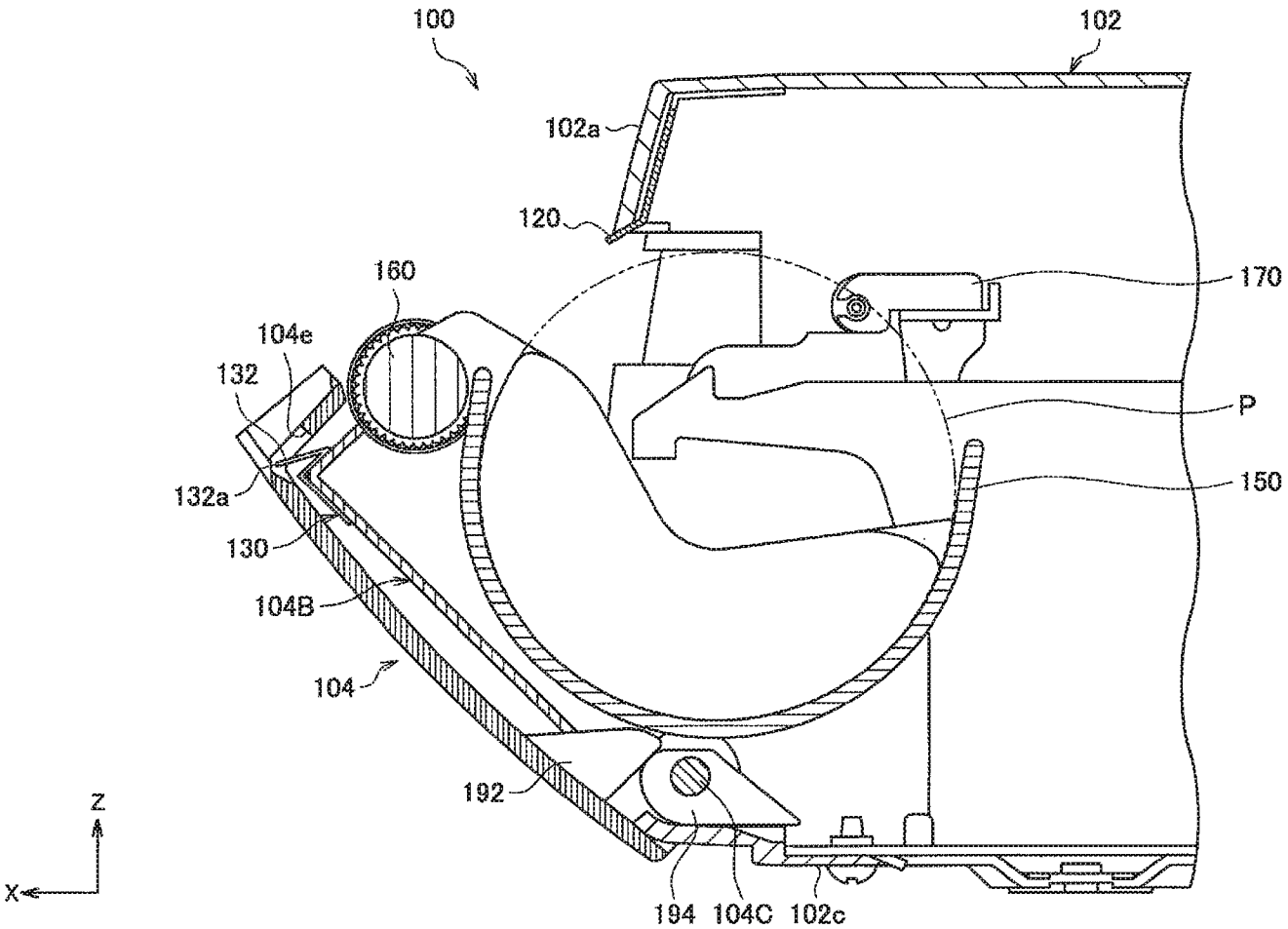
FIG. 8 is a partial cross-sectional view illustrating that the movable section is partially opened.
Figure 9:
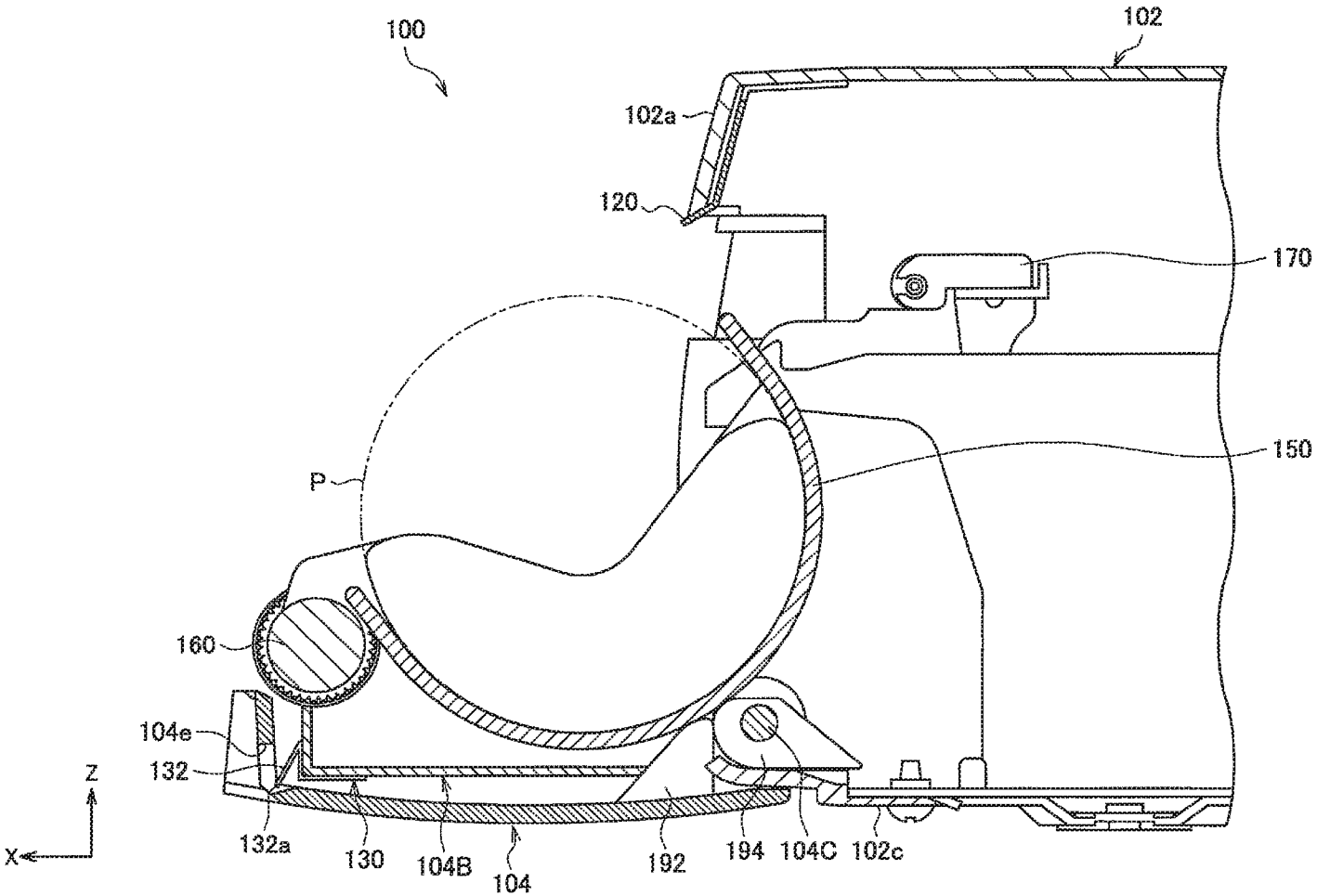
FIG. 9 is a partial cross-sectional view illustrating an open state in which the movable section is fully opened.

The printer 100 according to the present embodiment includes, as a manual cutting mechanism, an upper cutting section (second cutting section) 120 at the lower end 102*b* of the main body front face 102*a*, and a lower cutting section 130 (first cutting section) 130 in the recess 104*d* at the upper end 104*b* of the movable section 104. The following describes the manual cutting mechanism provided on the medical printer 100 according to the present embodiment on the basis of FIGS. 3 to 9. FIG. 3 is a front view of the movable section 104, FIG. 4 is a back view of the movable section 104, and FIG. 5 is a top view of the movable section 104. FIG. 6 is a partial cross-sectional view corresponding to the A-A cross section of FIG. 3 and illustrating a closed state in which the movable section 104 is closed against the main body 102, and illustrates that the upper cutting section 120 is cutting the roll sheet P. FIG. 7 is the same partial cross-sectional view as FIG. 6, and illustrates that the lower cutting section 130 is cutting the roll sheet P. FIG. 8 is a partial cross-sectional view illustrating that the movable section 104 is partially opened. FIG. 9 is a partial cross-sectional view illustrating an open state in which the movable section 104 is fully opened.

(1) Upper Cutting Section (Second Cutting Section)

The upper cutting section 120 is a manual cutting mechanism used when the roll sheet P ejected from the ejection port 110 is pulled up to be cut as illustrated in FIG. 6. The upper cutting section 120 includes a cutter blade extending in the width direction (y direction) of the ejection port 110. The cutter blade can be made of metal or resin such as plastic. The part of the cutter blade in contact with the roll sheet P is formed in a zigzag or a sharp shape as illustrated in FIG. 1 because it is easier to make a crack in the roll sheet P. The upper cutting section 120 does not have to be necessarily provided in the present embodiment.

(2) Lower Cutting Section (First Cutting Section)

The lower cutting section 130 is a manual cutting mechanism used when the ejected roll sheet P is pulled down to be cut. The lower cutting section 130 according to the present embodiment is provided on the movable section 104, and pivots with respect to the main body 102 along with the movable section 104. The movable section 104 includes a front panel 104A that covers the front face of the printer 100, and a door metal part 104B, and is configured to pivot on a rotating shaft 104C as the rotation center. In the present embodiment, the door metal part 104B can pivot only on the rotating shaft 104C. However, the front panel 104A is configured to be slightly movable in the radial direction in addition to pivoting on the rotating shaft 104C. The lower cutting section 130 is fixed to the door metal part 104B as illustrated in FIG. 6.

The lower cutting section 130 includes a cutter blade 132 that is a member for making a crack in the roll sheet P, and a fixation section 134 that is provided on the opposite side to the cutting edge of the cutter blade 132 and fixed to the door metal part 104B.

The cutter blade 132 is provided along the width direction (y direction) of the ejection port 110 similarly to the upper cutting section 120. When the movable section 104 enters the closed state with respect to the main body 102, a cutting edge 132*a* of the cutter blade 132 is exposed from the ejection port 110. If the cutter blade 132 is inclined in this state in a manner that the height position (the position in the z-axis direction) grows higher from the main body side to the cutting edge 132*a*, the roll sheet P can be smoothly ejected. If the cutting edge 132*a* is substantially vertical to the conveyance direction of the roll sheet P, the roll sheet P abuts the cutter blade 132*a* inside the main body 102 upon being pulled into the printer 100. As a result, the roll sheet P is not ejected from the ejection port 110 in some cases. Accordingly, if the cutting edge 132*a* of the cutter blade 132 is inclined to a vertical face (i.e., y-z plane) of the movable section 104 along the conveyance direction of the roll sheet P, the roll sheet P can be smoothly ejected. The cutter blade 132 can be made of metal or resin such as plastic. The part of the cutter blade 132 in contact with the roll sheet P is formed in a zigzag or a sharp shape because it is easier to make a crack in the roll sheet P.

The fixation section 134 is a member for fixing the cutter blade 132 to the door metal part 104B, and may be integrated with the cutter blade 132, for example, as illustrated in FIGS. 6 and 7. The fixation section 134 has the cross section of the z-x plane shaped like L to support, for example, the shape of the door metal part 104B having the L-shaped cross section of the x-z plane. The end of the horizontal portion of the fixation section 134 is coupled to the end opposite to the cutting edge 132*a* of the cutter blade 132. The inclination angle of the cutter blade 132 to the horizontal portion of the fixation section 134 may be set, for example, between approximately 20 to 30°. This can smoothly eject the roll sheet P, and easily make a crack at a cutting position of the roll sheet P.

(3) Slide Section

In the printer 100 according to the present embodiment, the front panel 104A is configured to be movable with respect to the door metal part 104B in the radial direction of the rotating shaft 104C in accordance with the open and closed states of the movable section 104. This sliding operation of the front panel 104A exposes the cutter blade 132 of the lower cutting section 130 from the ejection port 110 as illustrated in FIGS. 6 and 7 and allows the roll sheet P to be cut when the movable section 104 is in the closed state. Meanwhile, once the movable section 104 enters the open state, the front panel 104A is slid outward in the radial direction and the cutter blade 132 is covered by the front panel 104A as illustrated in FIGS. 8 and 9. That is to say, once the front panel 104A is opened, the cutter blade 132 is covered to prevent a user from touching the cutter blade 132 and to keep the safety.

The slide section according to the present embodiment includes a rib 192 provided on an inner face 104*c* of the front panel 104A, and a cam 194 provided on the main body 102 to abut the rib 192.

The rib 192 is a plate member that projects from the inner face 104*c* of the front panel 104A to the inside of the main body 102 as illustrated in FIG. 6. The rib 192 is shaped substantially triangular and has an abutting face 192*a* having the lower part side substantially parallel to a bottom face 102*c* of the main body 102 as seen, for example, from the y-axis direction. The rib 192 includes two ribs 192A and 192B that are provided, for example, on both sides of the inner face 104*c* of the front panel 104A in the width direction as illustrated in FIG. 4.

The cam 194 is fixed onto the inner side of the bottom face 102*c* of the main body 102 as illustrated in FIG. 6. The cam 194 includes two cams provided in association with the ribs 192A and 192B. The cam 194 has a first face 194*a* having the upper part side substantially parallel to the bottom face 102*c* of the main body 102 as seen, for example, from the y-axis direction, and a second face 194*b* that is arc-shaped from the end of the first face 194*a* on the front panel 104A side.

The abutting face 192*a* of the rib 192 is in contact with the first face 194*a* and the second face 194*b* of the cam 194. The abutting face 192*a* of the rib 192 moves along the first face 194*a* and the second face 194*b* of the cam 194 in accordance with the opening and closing of the movable section 104.

First of all, when the movable section 104 is in the closed state, the abutting face 192*a* of the rib 192 abuts the first face 194*a* of the cam 194 as illustrated in FIGS. 6 and 7. Pivoting the movable section 104 to open the movable section 104 moves the abutting face 192*a* of the rib 192 to the front panel 104A side along the first face 194*a* of the cam 194, and then moves the abutting face 192*a* from the first face 194*a* of the cam 194 to the second face 194*b* as illustrated in FIG. 8. At this time, the rib 192 is slid outward in the radial direction of the rotating shaft 104C. Meanwhile, the position of the lower cutting section 130 does not change. The cutter blade 132 is thus covered by the front panel 104A, and is not exposed.

The abutting face 192*a* of the rib 192 comes into contact with the different faces of the cam 194 in this way, thereby changing the moving direction of the rib 192. This slides the front panel 104A, which moves along with the rib 192, and changes the position in the radial direction of the rotating shaft 104C. The shape of the cam 194 is decided as appropriate in accordance with the open and closed positions at which the cutter blade 132 is desired to be covered with the front panel 104A. For example, when the movable section 104 is opened by a predetermined angle such as approximately 10 to 20° from the closed state in which the movable section 104 is completely closed, the abutting face 192*a* of the rib 192 may move from the first face 194*a* of the cam 194 to the second face 194*b*.

Further opening the movable section 104 moves the abutting face 192*a* of the rib 192 along the second face 194*b* of the cam 194. When the movable section 104 enters the open state in which the movable section 104 is completely opened, the cutter blade 132 is accommodated in the front panel 104A as illustrated in FIG. 9.

Meanwhile, when the movable section 104 transitions to the closed state illustrated in FIGS. 6 and 7 from the open state illustrated in FIG. 9, the movement is opposed to what has been described above. Pushing and closing the front panel 104A in the open state against the main body 102 side moves the abutting face 192*a* of the rib 192 along the second face 194*b* of the cam 194, and then to the first face 194*a*. On this occasion, the front panel 104A is slid toward the center in the radial direction of the rotating shaft 104C. When the movable section 104 enters the closed state, the front panel 104A fits with the main body front face 102*a* of the main body 102 and the front panel 104A remains pushed down. This exposes the cutter blade 132 and allows the roll sheet P to be cut when the front panel 104A is in the closed state.

[1.3. Cutting Roll Sheet]

FIGS. 6 and 7 illustrate methods for cutting the roll sheet P, the methods being performed by the upper cutting section 120 and the lower cutting section 130, which are manual cutting mechanisms of the medical printer 100 according to the present embodiment. FIGS. 6 and 7 illustrate the state of the roll sheet P, which is conveyed along the conveyance passage inside the printer 100 after the print unit prints on the roll sheet P accommodated in the accommodation unit 150. The roll sheet P conveyed from the print unit passes through between the conveyance roller 160 and a guide member 170 so that the conveyance speed and the conveyance quantity of the roll sheet P are adjusted. Only the printed portion is ejected from the ejection port 110.

First of all, as illustrated in FIG. 6, the roll sheet P ejected from the ejection port 110 is pulled up, and the upper cutting section 120 cuts the roll sheet P. When a user grasps the roll sheet P and pulled it up (z-axis positive direction), the roll sheet P abuts the tip of the upper cutting section 120 at the cutting position. When the user further pulls up one of the ends of the roll sheet P in the width direction, the upper cutting section 120 makes a crack in the roll sheet P at the end. When the user positions the cracked part at the cutting edge of the upper cutting section 120 and pulls up the roll sheet P toward the other end, the roll sheet P has continuous cracks and is finally cut away. Since the whole of the upper cutting section 120 is made of a cutter blade, the roll sheet P can be easily cut and a desired cross section can be obtained.

Meanwhile, as illustrated in FIG. 7, the roll sheet P ejected from the ejection port 110 is pulled down, and the lower cutting section 130 cuts the roll sheet P. When a user grasps the roll sheet P and pulls it down (z axis negative direction), the roll sheet P abuts the cutting edge 132*a* of the cutter blades 132 of the lower cutting section 130 at a cutting position. When the user positions the cracked part at the cutting edge 132*a* of the lower cutting section 130 and pulls down the roll sheet P toward the other end, the roll sheet P has continuous cracks and is finally cut away. Since the whole of the lower cutting section 130 is also made of a cutter blade, the roll sheet P can be easily cut and a desired cross section can be obtained.

As described above, since the medical printer 100 according to the present embodiment includes manual cutting mechanisms for cutting the roll sheet P at the upper and lower parts of the ejection port 110, from which the roll sheet P is ejected, the roll sheet P can be pulled and cut in any of the up direction and the down direction. Thus, for example, when the printer 100 is positioned on any one of the shelves 14*b* and 14*c* of the cart 10 as illustrated in FIG. 18, it is possible to pull and cut the roll sheet P in a direction in which a clearance is provided.

<2. Second Embodiment>

Figure 10:
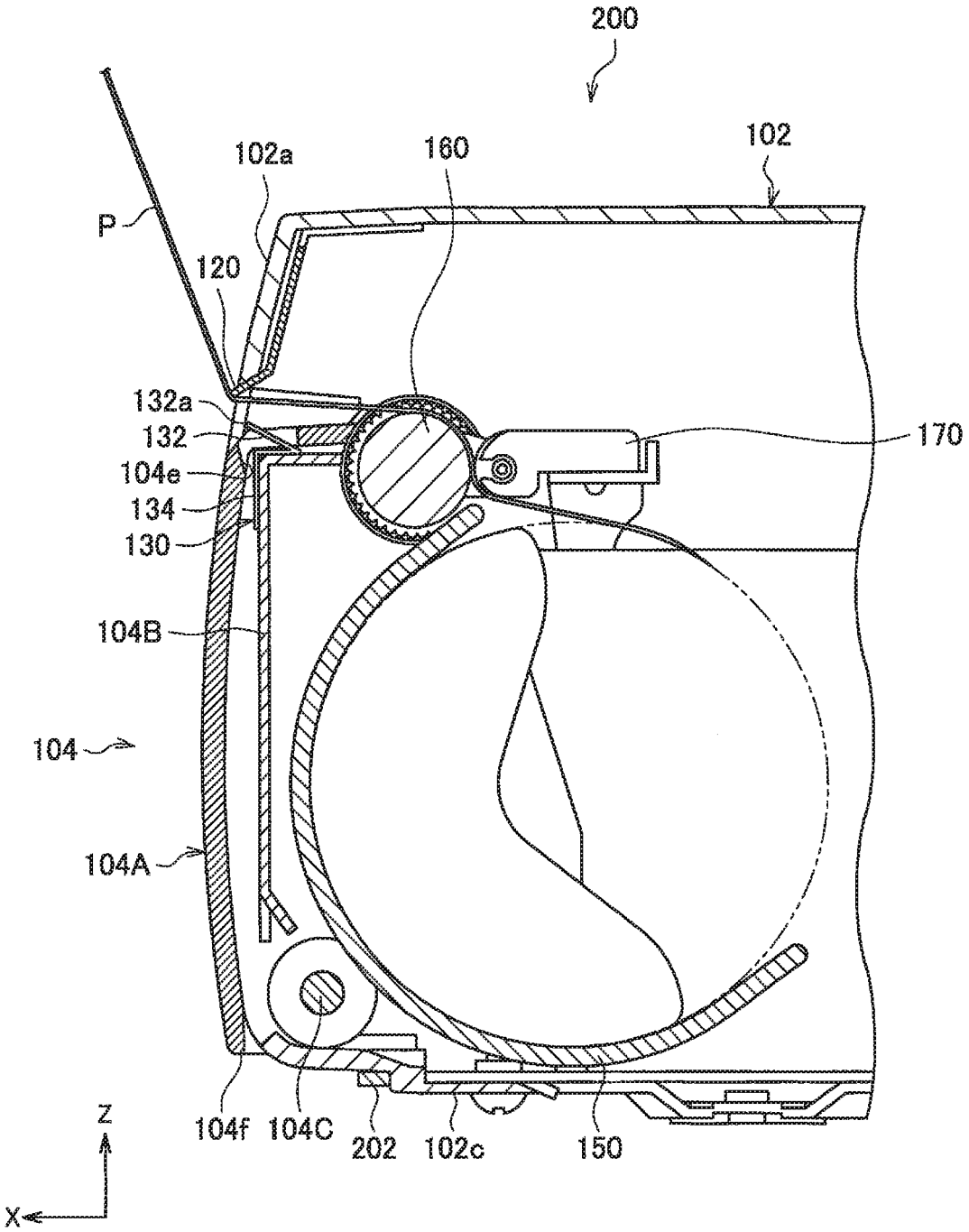
FIG. 10 is a partial cross-sectional view corresponding to the A-A cross section of FIG. 3 and illustrating a closed state in which a movable section of a printer according to a second embodiment of the present disclosure is closed against a main body.
Figure 11:
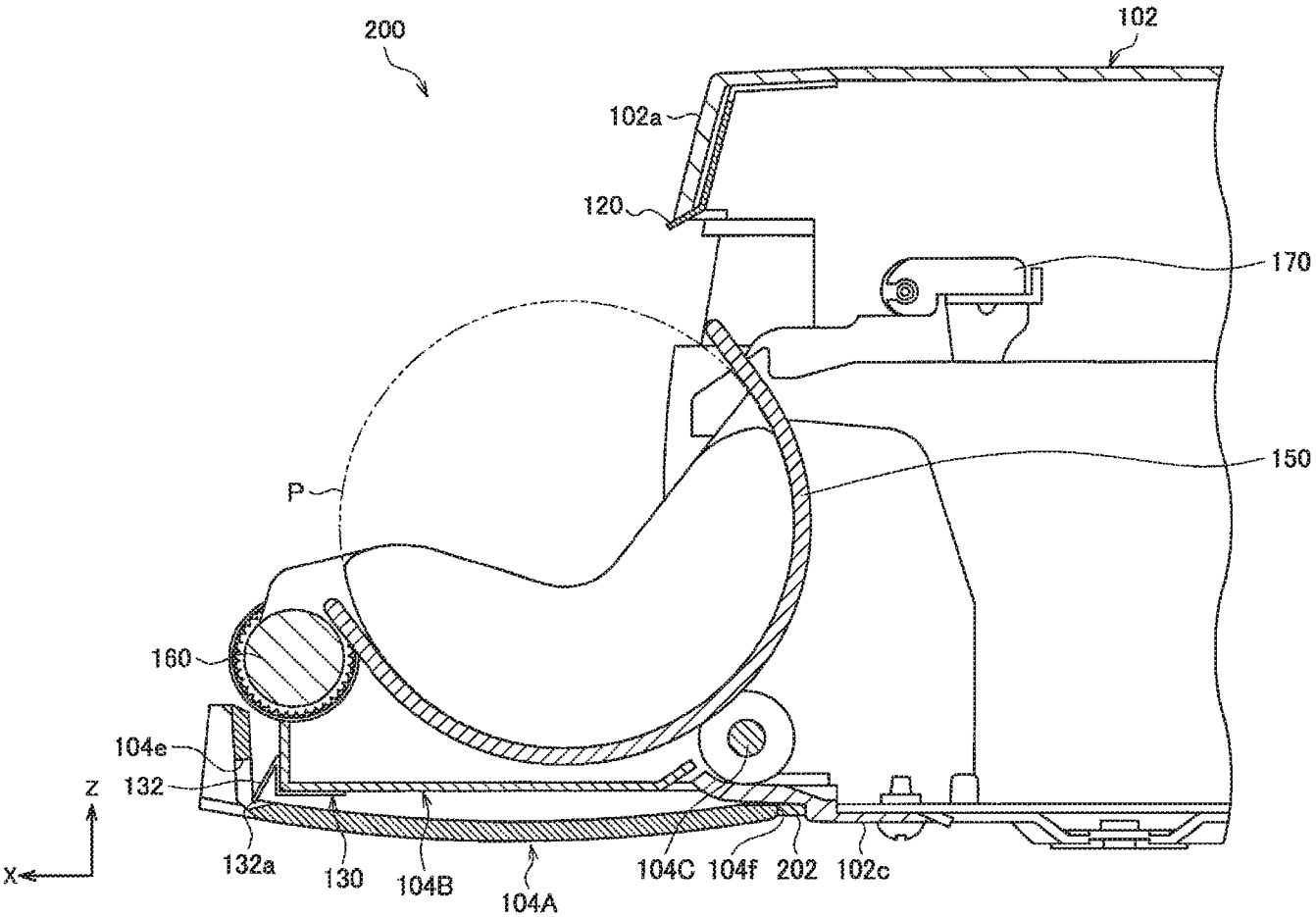
FIG. 11 is a partial cross-sectional view illustrating an open state in which the movable section is fully opened.

Next, the configuration of the sliding configuration of a printer 200 according to a second embodiment of the present disclosure will be described on the basis of FIGS. 10 and 11. FIG. 10 is a partial cross-sectional view corresponding to the A-A cross section of FIG. 3 and illustrating the closed state in which the movable section 104 is closed against the main body 102, and illustrates that the upper cutting section 120 is cutting the roll sheet P. FIG. 11 is a partial cross-sectional view illustrating the open state in which the movable section 104 is fully opened.

The printer 200 according to the present embodiment is different from the printer 100 according to the first embodiment in the configuration of the slide section that slides the front panel 104A in accordance with the open and closed states of the movable section 104. That is to say, the printer 200 according to the present embodiment has a protrusion 202 provided on the bottom face 102*c* of the main body 102 instead of the rib 192 and the cam 194 according to the first embodiment. The following describes the configuration of the slide section of the printer 200 according to the present embodiment and an advantageous effect thereof on the basis of FIGS. 10 and 11. Since each section of the printer 200 has a similar configuration to the configuration described in the first embodiment except for the protrusion 202, the detailed description will be omitted here.

[2.1. Protrusion]

The protrusion 202, which is a slide section that slides the front panel 104A of the movable section 104, is provided on the outer front side of the bottom face 102*c* of the main body 102 as illustrated in FIG. 10. The protrusion 202 is provided at the position at which the protrusion 202 abuts a lower face 104*f* of the pivoting front panel 104A when the movable section 104 is in the open state. As long as the protrusion 202 is provided at least partially in the width direction (y-axis direction), the protrusion 202 may be, for example, extended over the entire width, the two protrusions 202 may be provided near both ends, or the single protrusion 202 may be provided near the center. The protrusion 202 is, for example, made of the same material as that of the main body 102.

[2.2. Front Panel Slid by Protrusion]

In the printer 200 according to the present embodiment, the front panel 104A is configured to be movable with respect to the door metal part 104B in the radial direction of the rotating shaft 104C in accordance with the open and closed states of the movable section 104. This sliding operation of the front panel 104A exposes the cutter blade 132 of the lower cutting section 130 from the ejection port 110 as illustrated in FIG. 10 and allows the roll sheet P to be cut when the movable section 104 is in the closed state. Meanwhile, once the movable section 104 enters the open state, the front panel 104A is slid outward in the radial direction and the cutter blade 132 is covered by the front panel 104A as illustrated in FIG. 11. That is to say, once the front panel 104A is opened, the cutter blade 132 is covered to prevent a user from touching the cutter blade 132 and to keep the safety.

First of all, when the movable section 104 is in the closed state, the cutting edge 132*a* of the cutter blade 132 of the lower cutting section 130 is exposed from an opening 104*e* of the front panel 104A as illustrated in FIG. 10. The roll sheet P can be thus cut with the cutter blade 132 of the lower cutting section 130.

Pivoting the movable section 104 from the closed state to open the movable section 104 rotates the movable section 104 around the rotating shaft 104C. The lower face 104*f* of the front panel 104A then abuts the protrusion 202 provided on the main body 102 as illustrated in FIG. 11. At this time, the front panel 104A is slid outward in the radial direction of the rotating shaft 104C. Meanwhile, the position of the lower cutting section 130 does not change. The cutter blade 132 is thus covered by the front panel 104A, and is not exposed. It is adjusted as appropriate how much the protrusion 202 slides the front panel 104A, in a manner that the cutting edge 132*a* of the cutter blade 132 is hidden when the front panel 104A is pushed up by the protrusion 202.

Meanwhile, when the movable section 104 transitions to the closed state illustrated in FIG. 10 from the open state illustrated in FIG. 11, the movement is opposed to what has been described above. Pushing and closing the front panel 104A in the open state against the main body 102 side pivots and slides the front panel 104A toward the center in the radial direction of the rotating shaft 104C as much as the protrusion 202 has slid the front panel 104A. When the movable section 104 enters the closed state, the front panel 104A fits with the main body front face 102*a* of the main body 102 and the front panel 104A remains pushed down. This exposes the cutter blade 132 and allows the roll sheet P to be cut when the front panel 104A is in the closed state.

The configuration of the protrusion 202, which is a slide section of the printer 200 according to the second embodiment of the present disclosure, and an advantageous effect thereof have been described so far. In the present embodiment, the protrusion 202 provided on the bottom face 102*c* of the main body 102 slides the front panel 104A in the radial direction of the rotating shaft 104C in accordance with the open and closed states of the movable section 104. This exposes the cutter blade 132 of the lower cutting section 130 and allows the roll sheep P to be cut when the movable section 104 is in the closed state. The front panel 104A is slid in the process of making the movable section 104 transition from the closed state to the open state, covering the cutter blade 132 with the front panel 104A. Even when the movable section 104 is in the open state, a user can thus, for example, replace the roll sheep P safely.

<3. Third Embodiment>

Figure 12:
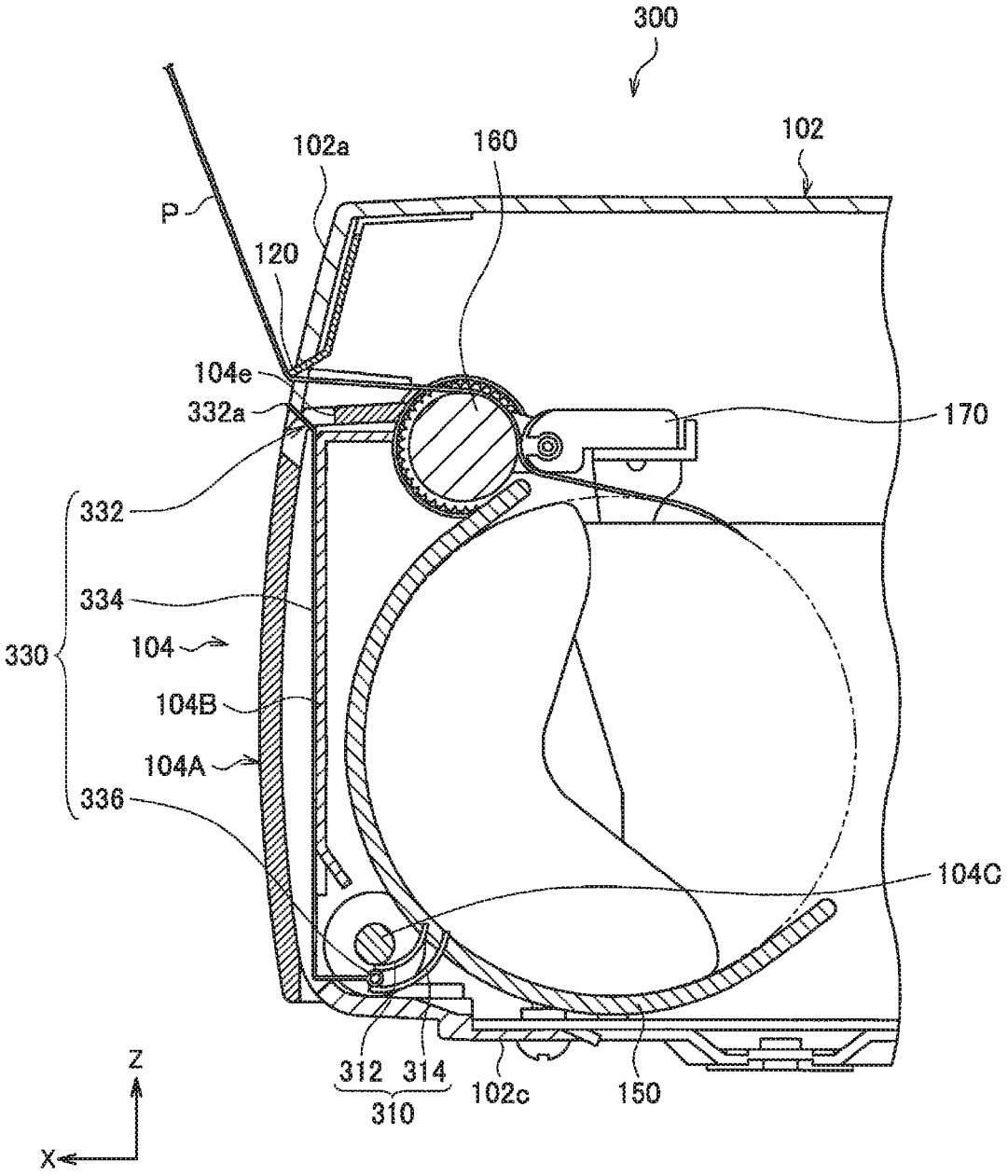
FIG. 12 is a partial cross-sectional view corresponding to the A-A cross section of FIG. 3 and illustrating a closed state in which a movable section of a printer according to a third embodiment of the present disclosure is closed against a main body.
Figure 13:
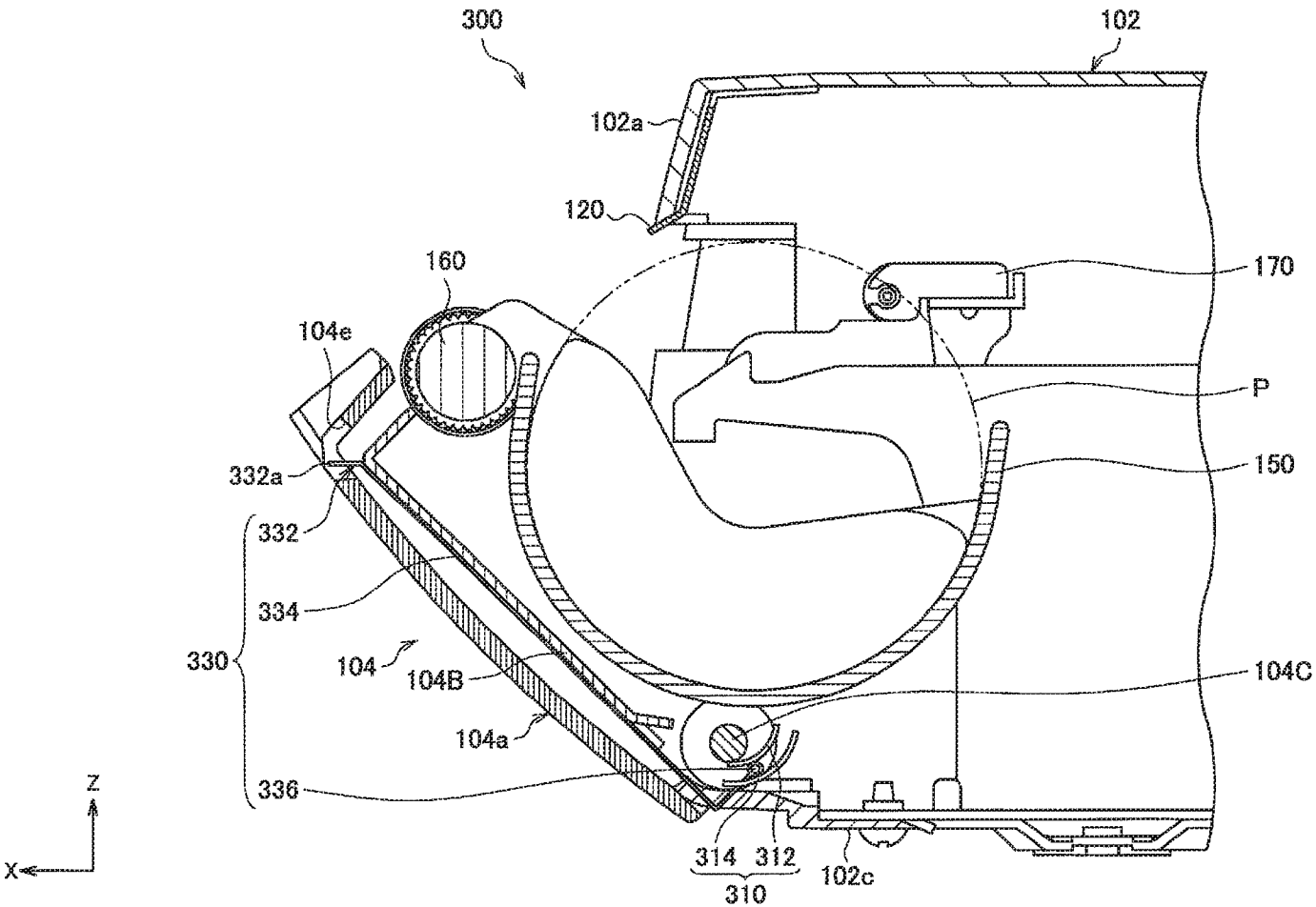
FIG. 13 is a partial cross-sectional view illustrating that the movable section is partially opened.
Figure 14:
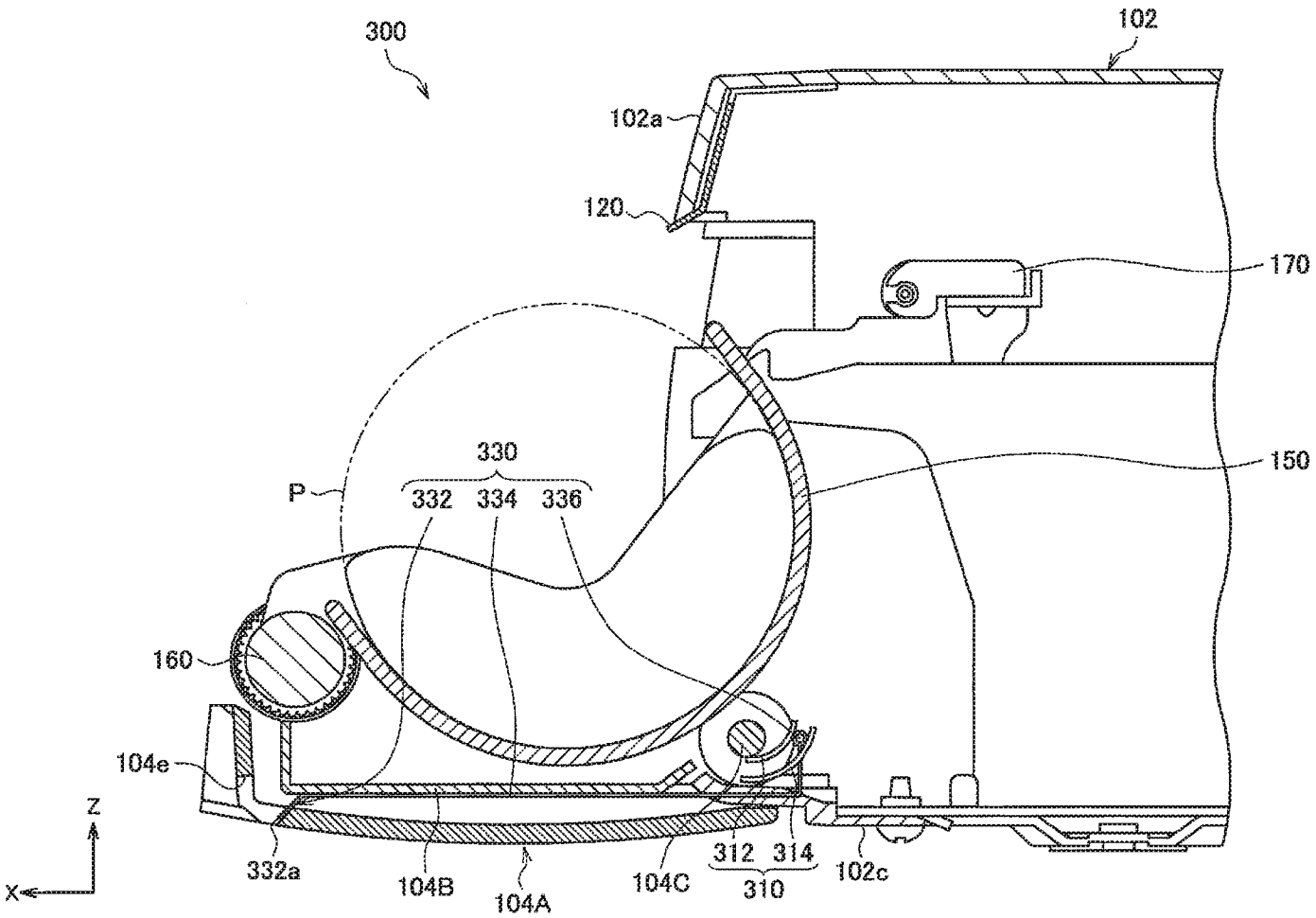
FIG. 14 is a partial cross-sectional view illustrating an open state in which the movable section is fully opened.

Next, the configuration of the sliding configuration of a printer 300 according to a third embodiment of the present disclosure will be described on the basis of FIGS. 12 to 14. FIG. 12 is a partial cross-sectional view corresponding to the A-A cross section of FIG. 3 and illustrating the closed state in which the movable section 104 is closed against the main body 102, and illustrates that the upper cutting section 120 is cutting the roll sheet P. FIG. 13 is a partial cross-sectional view illustrating that the movable section 104 is partially opened. FIG. 14 is a partial cross-sectional view illustrating an open state in which the movable section 104 is fully opened.

The printer 300 according to the present embodiment is different from the printer 100 according to the first embodiment and the printer 200 according to the second embodiment in that a lower cutting section 330 is slid in accordance with the open and closed states of the movable section 104. The following describes the configuration of the slide section of the printer 300 according to the present embodiment and an advantageous effect thereof. Since each section of the printer 300 other than the lower cutting section 330 and a guide section 310 for sliding the lower cutting section 330 has a similar configuration to the configuration described in the first embodiment, the detailed description will be omitted here.

[3.1. Configuration of Lower Cutting Section]

The lower cutting section 330 of the printer 300 according to the present embodiment includes a cutter blade 332, a coupling section 334 that couples a cutter blade 322 and a slider 336, the slider 336 that slides along the guide section 310 as illustrated in FIG. 12. The cutter blade 332 is configured similarly to the cutter blade 132 according to the first embodiment. In the present embodiment, the cutter blade 332 slides in the radial direction of the rating shaft 104C while the slider 336 slides along the guide section 310 in accordance with the open and closed states of the movable section 104.

The guide section 310 is provided, for example, on the inner face of the side face (the face in the y-axis direction) of the main body 102, and is formed to allow the slider 336 to slide between two guides 312 and 314 as illustrated in FIG. 12. The guides 312 and 314 are, for example, made of the same material as that of the main body 102.

[3.2. Sliding Cutter Blade]

In the printer 300 according to the present embodiment, the lower cutting section 330 is configured to be movable with respect to the front panel 104A in the radial direction of the rotating shaft 104C in accordance with the open and closed states of the movable section 104. This sliding operation of the lower cutting section 330 exposes the cutter blade 332 of the lower cutting section 330 from the ejection port 110 as illustrated in FIG. 12 and allows the roll sheet P to be cut when the movable section 104 is in the closed state. Meanwhile, once the movable section 104 enters the open state, the cutter blade 332 is slid toward the rotation center in the radial direction as illustrated in FIG. 14 and the cutter blade 332 is accommodated in the front panel 104A and covered by the front panel 104A. That is to say, once the front panel 104A is opened, the cutter blade 332 is covered by the front panel 104A to prevent a user from touching the cutter blade 332 and to keep the safety.

First of all, when the movable section 104 is in the closed state, the cutting edge 332*a* of the cutter blade 332 of the lower cutting section 330 is exposed from the opening 104*e* of the front panel 104A as illustrated in FIG. 12. The roll sheet P can be thus cut with the cutter blade 332 of the lower cutting section 330.

Pivoting the movable section 104 from the closed state to open the movable section 104 rotates the movable section 104 around the rotating shaft 104C. The slider 336 moves along the guide section 310 counterclockwise in the middle state between the open state and the closed state as illustrated in FIG. 13, thereby sliding the cutter blade 332 toward the rotation center of the rotating shaft 104C. Once the front panel 104A completely opens and enters the open state as illustrated in FIG. 14, the cutter blade 332 is slid the most toward the rotation center in the radial direction of the rotating shaft 104C, and accommodated in the opening 104*e* of the front panel 104A. The position of the front panel 104A does not change. The cutter blade 132 is covered by the front panel 104A in this way, and is not exposed.

Meanwhile, when the movable section 104 transitions to the closed state illustrated in FIG. 12 from the open state illustrated in FIG. 14, the movement is opposed to what has been described above. Pushing and closing the front panel 104A in the open state against the main body 102 side pivots and moves the slider 336 of the lower cutting section 330 clockwise along the guide section 310. At this time, the cutter blade 332 is gradually slid outward in the radial direction of the rotating shaft 104C. When the movable section 104 enters the closed state and the front panel 104A fits with the main body front face 102*a* of the main body 102, the cutter blade 332 is exposed from the opening 104*e* of the front panel 104A. This exposes the cutter blade 332 and allows the roll sheet P to be cut when the front panel 104A is in the closed state.

The configuration of the lower cutting section 330 of the printer 300 according to the third embodiment of the present disclosure and an advantageous effect thereof have been described so far. In the present embodiment, the lower cutting section 330 is configured to be slidable in the radial direction of the rotating shaft 104C in accordance with the open and closed states of the movable section 104. This exposes the cutter blade 332 of the lower cutting section 330 and allows the roll sheep P to be cut when the movable section 104 is in the closed state. The lower cutting section 330 is slid in the process of making the movable section 104 transition from the closed state to the open state. When the movable section 104 enters the open state, the cutter blade 332 is accommodated in the front panel 104A and covered by the front panel 104A. Even when the movable section 104 is in the open state, a user can thus, for example, replace the roll sheep P safely.

<4. Fourth Embodiment>

Figure 15:
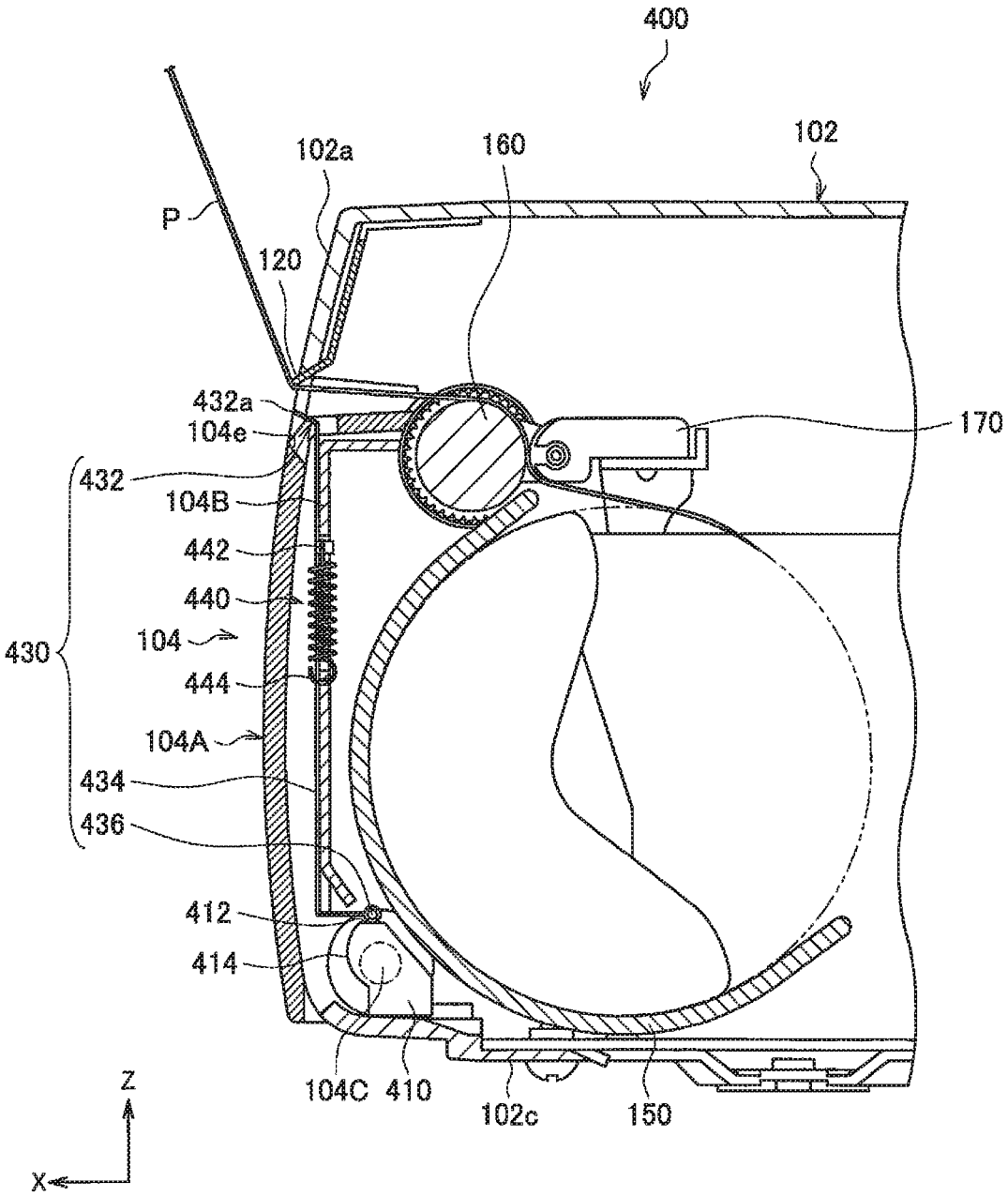
FIG. 15 is a partial cross-sectional view corresponding to the A-A cross section of FIG. 3 and illustrating a closed state in which a movable section of a printer according to a fourth embodiment of the present disclosure is closed against a main body.
Figure 16:
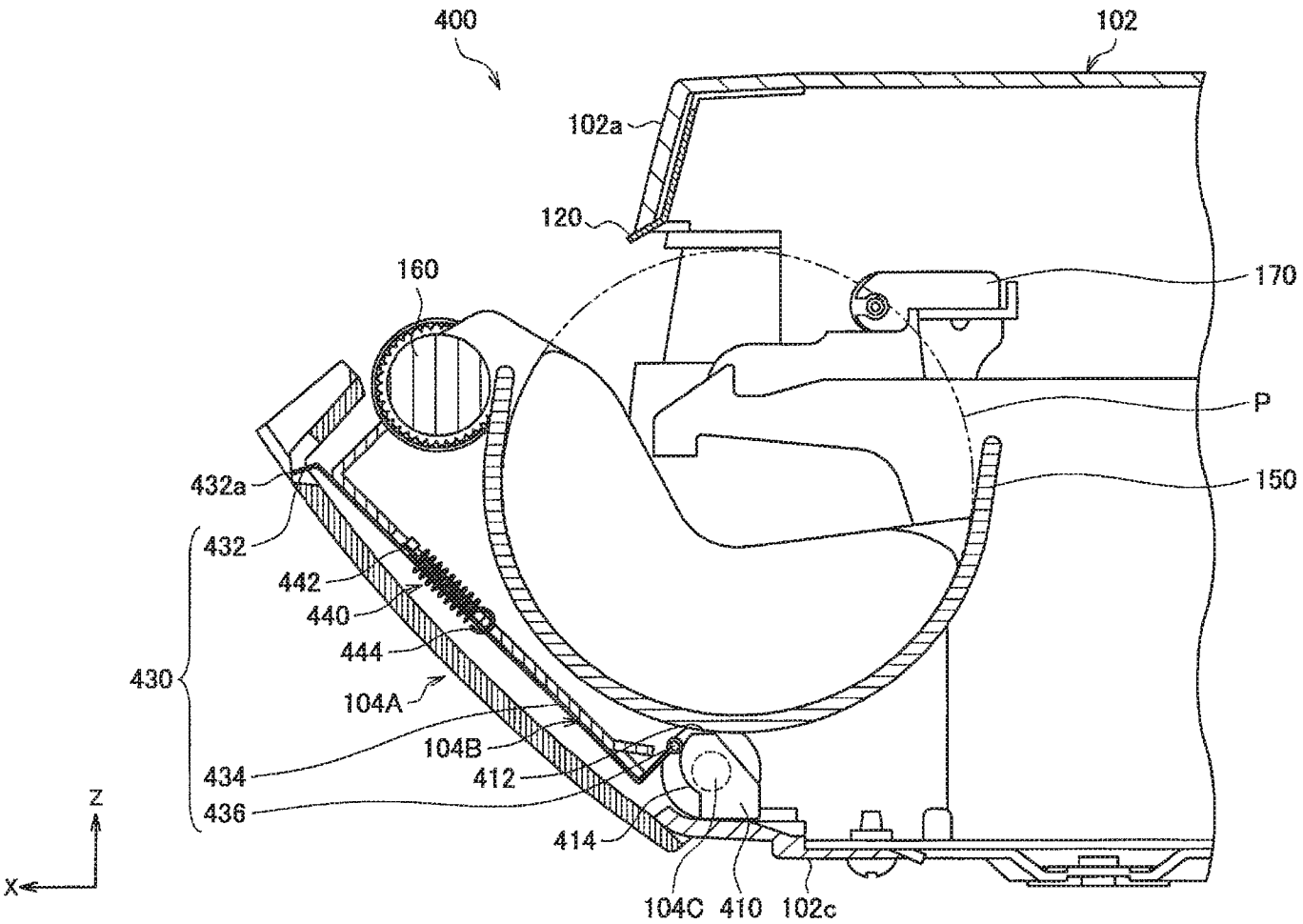
FIG. 16 is a partial cross-sectional view illustrating that the movable section is partially opened.
Figure 17:
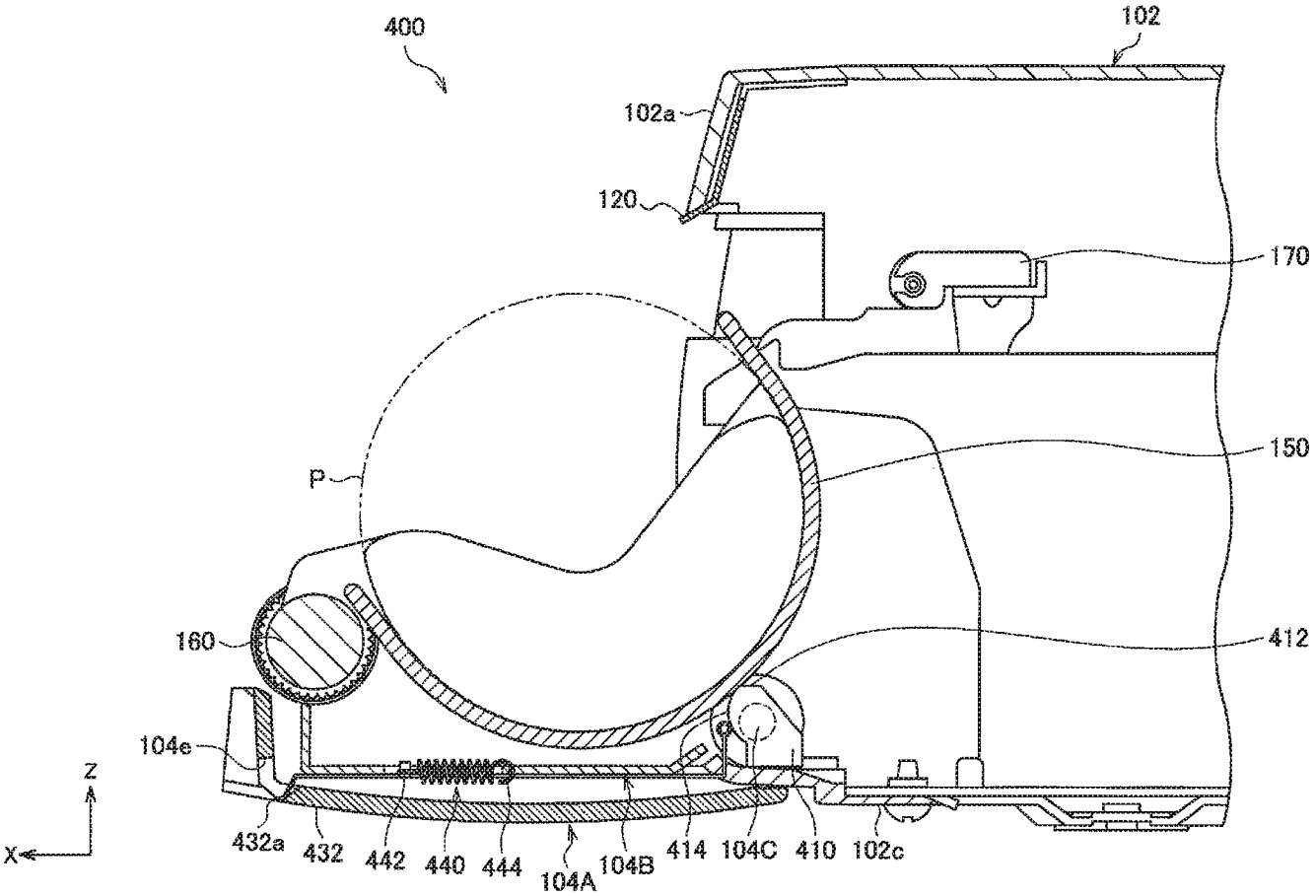
FIG. 17 is a partial cross-sectional view illustrating an open state in which the movable section is fully opened.

Next, the configuration of the sliding configuration of a printer 400 according to a fourth embodiment of the present disclosure will be described on the basis of FIGS. 15 to 17. FIG. 15 is a partial cross-sectional view corresponding to the A-A cross section of FIG. 3 and illustrating the closed state in which the movable section 104 is closed against the main body 102, and illustrates that the upper cutting section 120 is cutting the roll sheet P. FIG. 16 is a partial cross-sectional view illustrating that the movable section 104 is partially opened. FIG. 17 is a partial cross-sectional view illustrating an open state in which the movable section 104 is fully opened.

The printer 400 according to the present embodiment is configured to have a lower cutting section 430 slide in accordance with the open and closed states of the movable section 104 similarly to the third embodiment. The printer 400 is different from the printer 300 according to the third embodiment in that the lower cutting section 430 is slid by spring action in the radial direction of the rotating shaft 104C. The following describes the configuration of the slide section of the printer 400 according to the present embodiment and an advantageous effect thereof. Since each section of the printer 400 other than the lower cutting section 430 and a guide section 410 for sliding the lower cutting section 430 has a similar configuration to the configuration described in the third embodiment, the detailed description will be omitted here.

[4.1. Configuration of Lower Cutting Section]

The lower cutting section 430 of the printer 400 according to the present embodiment includes a cutter blade 432, a coupling section 434 that couples the cutter blade 432 and a slider 436, the slider 436 that slides along the guide section 410 similarly to the third embodiment as illustrated in FIG. 15. The cutter blade 432 is configured similarly to the cutter blade 132 according to the first embodiment. In the present embodiment, the cutter blade 432 slides in the radial direction of the rating shaft 104C while the slider 436 slides along the guide section 410 in accordance with the open and closed states of the movable section 104.

The guide section 410 is provided, for example, on the inner face of the side face (the face in the y-axis direction) of the main body 102, and is formed as a cam as illustrated in FIG. 15. The guide section 410 has a first face 412 having the upper part side substantially parallel to the bottom face 102*c* of the main body 102 as seen, for example, from the y-axis direction, and a second face 414 that is arc-shaped from the end of the first face 412 on the front panel 104A side. The slider 436 of the lower cutting section 430 is in contact with the first face 412 and the second face 414 of the guide section 410. The slider 436 moves along the first face 412 and the second face 414 of the guide section 410 in accordance with the opening and closing of the movable section 104.

Tension is added to the cutter blade 432 of the lower cutting section 430 according to the present embodiment by a spring member 440 that is provided to extend when the movable section 104 is in the closed state. The spring member 440 may be, for example, an extension spring that adds force in the pulling direction. A fixed end 442 of the spring member 440 is fixed to a projection provided on the coupling section 434 of the lower cutting section 430. Meanwhile, a hook section 444 of the spring member 440 is hooked on the door metal part 104B.

[4.2. Sliding Cutter Blade]

In the printer 400 according to the present embodiment, the lower cutting section 430 is configured to be movable with respect to the front panel 104A in the radial direction of the rotating shaft 104C in accordance with the open and closed states of the movable section 104. This sliding operation of the lower cutting section 430 exposes the cutter blade 432 of the lower cutting section 430 from the ejection port 110 as illustrated in FIG. 15 and allows the roll sheet P to be cut when the movable section 104 is in the closed state. Meanwhile, once the movable section 104 enters the open state, the cutter blade 432 is slid toward the rotation center in the radial direction and the cutter blade 432 is accommodated in the front panel 104A as illustrated in FIG. 17. That is to say, once the front panel 104A is opened, the cutter blade 432 is covered by the front panel 104A to prevent a user from touching the cutter blade 432 and to keep the safety.

First of all, when the movable section 104 is in the closed state, the cutting edge 432*a* of the cutter blade 432 of the lower cutting section 430 is exposed from the opening 104*e* of the front panel 104A as illustrated in FIG. 15. The roll sheet P can be thus cut with the cutter blade 432 of the lower cutting section 430. At this time, the spring member 440 extends to keep force for pulling the cutter blade 432 toward the rotation center of the rotating shaft 104C, but the tension of the spring member 440 does not act on the cutter blade 432 while the slider 436 is in contact with the first face 412 of the guide section 410.

Pivoting the movable section 104 from the closed state to open the movable section 104 rotates the movable section 104 around the rotating shaft 104C. Once the slider 336 begins to move from the first face 412 of the guide section 410 along the second face 414 in the middle state between the open state and the closed state as illustrated in FIG. 16, the tension of the spring member 440 is applied to the cutter blade 432, thereby sliding the cutter blade 432 toward the rotation center of the rotating shaft 104C. This causes the cutter blade 432 to be accommodated in the front panel 104A, and the cutter blade 432 is not exposed.

Once the front panel 104A completely opens and enters the open state as illustrated in FIG. 17, the cutter blade 432 is slid the most toward the rotation center in the radial direction of the rotating shaft 104C, and accommodated in the opening 104*e* of the front panel 104A. The position of the front panel 104A does not change. The cutter blade 132 is covered by the front panel 104A in this way, and is not exposed.

Meanwhile, when the movable section 104 transitions to the closed state illustrated in FIG. 15 from the open state illustrated in FIG. 17, the movement is opposed to what has been described above. Pushing and closing the front panel 104A in the open state against the main body 102 side pivots and moves the slider 436 of the lower cutting section 430 clockwise along the second face 414 of the guide section 410. At this time, the cutter blade 432 is gradually slid outward in the radial direction of the rotating shaft 104C. Once the slider 436 moves from the second face 414 of the guide section 410 to the first face 412, the spring member 440 extends. When the movable section 104 enters the closed state and the front panel 104A fits with the main body front face 102*a* of the main body 102, the cutter blade 432 is exposed from the opening 104*e* of the front panel 104A. This exposes the cutter blade 332 and allows the roll sheet P to be cut when the front panel 104A is in the closed state. At this time, the spring member 440 remains extended.

The configuration of the lower cutting section 430 of the printer 400 according to the fourth embodiment of the present disclosure and an advantageous effect thereof have been described so far. In the present embodiment, the lower cutting section 430 is configured to be slidable in the radial direction of the rotating shaft 104C in accordance with the open and closed states of the movable section 104. This exposes the cutter blade 432 of the lower cutting section 430 and allows the roll sheep P to be cut when the movable section 104 is in the closed state. The lower cutting section 430 receives the tension of the spring member 440 and is slid in the process of making the movable section 104 transition from the closed state to the open state. Meanwhile, when the movable section 104 enters the open state, the cutter blade 432 is accommodated in the front panel 104A and covered by the front panel 104A. Even when the movable section 104 is in the open state, a user can thus, for example, replace the roll sheep P safely.

The preferred embodiment(s) of the present disclosure has/have been described above with reference to the accompanying drawings, whilst the present disclosure is not limited to the above examples. A person skilled in the art may find various alterations and modifications within the scope of the appended claims, and it should be understood that they will naturally come under the technical scope of the present disclosure.

For example, in the above-described embodiments, the cutter blades of the first cutting section and the second cutting section are configured with a single member that extends in the width direction (y direction) of the ejection port 110. The present technology is not, however, limited to such an example. For example, the cutter blades of the first cutting section and the second cutting section may also be configured with cutter blades provided in the width direction of the ejection port 110. For example, three cutter blades may be disposed at intervals of several mm.

Further, the effects described in this specification are merely illustrative or exemplified effects, and are not limitative. That is, with or in the place of the above effects, the technology according to the present disclosure may achieve other effects that are clear to those skilled in the art based on the description of this specification.

Additionally, the present technology may also be configured as below.

(1)

A medical printer including:

a main body that accommodates a roll sheet;

a movable section including a front panel that covers a front face, the movable section being capable of opening and closing against the main body;

a first cutting section provided on the movable section, and configured to cut the roll sheet ejected from an ejection port defined by the main body and the movable section; and a slide section configured to slide the front panel or the first cutting section in a radial direction with respect to a rotation center of the movable section in accordance with open and closed states of the movable section.

(2)

The medical printer according to (1), wherein the slide section includes a rib provided on an inner face of the front panel, and a cam provided on the main body in a manner that the cam abuts the rib, and when the movable section is in the open state, the front panel is slid by the cam outward in the radial direction, and the first cutting section is accommodated in the front panel that has been slid.

(3)

The medical printer according to (2), wherein the cam is shaped to slide the front panel outward in the radial direction when the movable section opens by a predetermined angle from the closed state.

(4)

The medical printer according to (1), wherein the slide section includes a protrusion provided at a position at which a bottom face of the front panel faces a bottom face of the main body when the movable section is in the open state, and when the movable section is in the open state, the front panel is slid by the protrusion outward in the radial direction, and the first cutting section is accommodated in the front panel that has been slid.

(5)

The medical printer according to (1), wherein the slide section includes a slider that is provided on an opposite side to a cutting edge of the first cutting section, and a guide section that is provided on the main body and guides the slider, and when the movable section is in the open state, the slider is slid by the guide section outward in the radial direction, and the first cutting section is accommodated in the front panel.

(6)

The medical printer according to (1), wherein the slide section includes a slider that is provided on an opposite side to a cutting edge of the first cutting section, a guide section that is provided on the main body and guides the slider, and a spring member that is provided on the first cutting section in a manner that the spring member extends in a direction which connects the first cutting section to the rotation center of the movable section when the movable section is in the closed state, and when the movable section opens by a predetermined angle from the closed state, the slider is pulled by the spring member outward in the radial direction, and the first cutting section is accommodated in the front panel.

(7)

The medical printer according to any one of (1) to (6), wherein the first cutting section includes one or more cutter blades disposed in a width direction of the ejection port.

(8)

The medical printer according to any one of (1) to (7), including:

a second cutting section provided on the main body, and configured to cut the roll sheet ejected from the ejection port.

REFERENCE SIGNS LIST

10 cart
100, 200, 300, 400 printer (medical printer)
102 main body
102*c* bottom face
104 movable section
104A front panel
104B door metal part
104C rotating shaft
104*e* opening
110 ejection port
120 upper cutting section (second cutting section)
130, 330, 430 lower cutting section (first cutting section)
132, 332, 432 cutter blade
140 operation display section
150 accommodation section
160 conveyor roller
170 guide member
202 protrusion
310, 410 guide section
312, 314 guide
334, 434 coupling section
336, 436 slider
412 first face (of the guide section 410)
414 second face (of the guide section 410)
440 spring member
442 fixed end
444 hook section
P roll sheet

The invention claimed is:

1. A medical printer comprising:

a main body that accommodates a roll sheet;

a movable section including a front panel that covers a front face, the movable section being capable of opening and closing against the main body;

a first cutting section provided on the movable section, and configured to cut the roll sheet ejected from an ejection port defined by the main body and the movable section; and a slide section configured to slide the front panel or the first cutting section in a radial direction with respect to a rotation center of the movable section in accordance with open and closed states of the movable section.

2. The medical printer according to claim 1, wherein the slide section includes a rib provided on an inner face of the front panel, and a cam provided on the main body in a manner that the cam abuts the rib, and when the movable section is in the open state, the front panel is slid by the cam outward in the radial direction, and the first cutting section is accommodated in the front panel that has been slid.

3. The medical printer according to claim 2, wherein the cam is shaped to slide the front panel outward in the radial direction when the movable section opens by a predetermined angle from the closed state.

4. The medical printer according to claim 1, wherein the slide section includes a protrusion provided at a position at which a bottom face of the front panel faces a bottom face of the main body when the movable section is in the open state, and when the movable section is in the open state, the front panel is slid by the protrusion outward in the radial direction, and the first cutting section is accommodated in the front panel that has been slid.

5. The medical printer according to claim 1, wherein the slide section includes a slider that is provided on an opposite side to a cutting edge of the first cutting section, and a guide section that is provided on the main body and guides the slider, and when the movable section is in the open state, the slider is slid by the guide section outward in the radial direction, and the first cutting section is accommodated in the front panel.

6. The medical printer according to claim 1, wherein the slide section includes a slider that is provided on an opposite side to a cutting edge of the first cutting section, a guide section that is provided on the main body and guides the slider, and a spring member that is provided on the first cutting section in a manner that the spring member extends in a direction which connects the first cutting section to the rotation center of the movable section when the movable section is in the closed state, and when the movable section opens by a predetermined angle from the closed state, the slider is pulled by the spring member outward in the radial direction, and the first cutting section is accommodated in the front panel.

7. The medical printer according to claim 1, wherein the first cutting section includes one or more cutter blades disposed in a width direction of the ejection port.

8. The medical printer according to claim 1, comprising:

a second cutting section provided on the main body, and configured to cut the roll sheet ejected from the ejection port.

* * * * *